US007871112B2

(12) United States Patent
Kondratuk et al.

(10) Patent No.: US 7,871,112 B2
(45) Date of Patent: Jan. 18, 2011

(54) REVERSIBLE DOUBLE DEADBOLT MORTISE LATCH

(75) Inventors: Michael W. Kondratuk, Cameron, WI (US); John K. Berkseth, Rice Lake, WI (US)

(73) Assignee: Hardware Specialties, Inc., Spooner, WI (US)

( * ) Notice: Subject to any disclaimer, the term of this patent is extended or adjusted under 35 U.S.C. 154(b) by 104 days.

(21) Appl. No.: 11/071,482

(22) Filed: Mar. 3, 2005

(65) Prior Publication Data

US 2006/0208496 A1 Sep. 21, 2006

(51) Int. Cl.
*E05C 1/02* (2006.01)

(52) U.S. Cl. ..... 292/137

(58) Field of Classification Search ..... 292/156 X, 292/157, 159 X, 137, 174, 182, 140, 163, 292/169, 32, 37–38, 42, 141–142; 70/141, 70/144, 224

See application file for complete search history.

(56) References Cited

U.S. PATENT DOCUMENTS

| | | | | |
|---|---|---|---|---|
| 1,131,247 | A | 3/1915 | Kickert | 292/51 |
| 1,956,388 | A | 4/1934 | Kalina | |
| 2,406,459 | A | 8/1946 | Gibson | 292/39 |
| 2,676,827 | A | 4/1954 | Schlage | |
| 2,707,121 | A | 4/1955 | Behnke | |
| 2,929,651 | A | 3/1960 | Friedman et al. | |
| 2,939,737 | A * | 6/1960 | Nygren | 292/170 |

(Continued)

FOREIGN PATENT DOCUMENTS

| | | |
|---|---|---|
| GB | 2 101 672 | 1/1983 |

OTHER PUBLICATIONS

"New storm door system cuts install time in half" http:pressroom.pella.com/news_releases/display.htm. (Mar. 8, 2005).

*Primary Examiner*—Carlos Lugo
*Assistant Examiner*—Mark Williams
(74) *Attorney, Agent, or Firm*—Moss & Barnett

(57) ABSTRACT

A reversible, double deadbolt latch bolt assembly for securing and locking a door is provided according to the invention. It comprises a lock body to which is slidably mounted a live bolt for movement between an extended position and a retracted position, the live bolt being operated by an actuator, such as a handle cam rotated by means of a door knob or lever-operated spindle. Also slidably mounted to the lock body are at least two cam-operated deadbolts on opposite sides of the live bolt for movement between a locked position and an unlocked position. These cams may optionally be linked to each other within the lock body, so that operation of one of the cams by, e.g., a key cylinder or thumb turn causes simultaneous operation of the other cam. Because of the symmetrical design and structure of the latch bolt assembly of the present invention, it enables a door into which it is inserted to be installed for both left-hand and right-hand hinged applications by mere flipping of the door by the installer without the need to remove the latch bolt assembly in order to further remove and invert the live bolt contained therein, as is customary within the industry. Alternatively, a bi-directional actuator for the live bolt can be used in conjunction with a single deadbolt, such combination still permitting the door to be flipped to accommodate both left-hand and right-hand hinged applications of a door during installation.

18 Claims, 33 Drawing Sheets

U.S. PATENT DOCUMENTS

| | | | | | |
|---|---|---|---|---|---|
| 2,978,267 | A | | 4/1961 | North et al. | |
| 3,951,444 | A | | 4/1976 | Shull | |
| 3,990,277 | A | | 11/1976 | Mullich | |
| 4,011,741 | A | | 3/1977 | Nolin | |
| 4,109,494 | A | | 8/1978 | Allemann | |
| 4,671,089 | A | | 6/1987 | Fleming et al. | |
| 4,784,417 | A | | 11/1988 | Fleming et al. | |
| 4,864,835 | A | | 9/1989 | Wartian | |
| 5,058,938 | A | | 10/1991 | Döring et al. | 292/45 |
| 5,072,976 | A | | 12/1991 | Meszaros | |
| 5,120,094 | A | | 6/1992 | Eaton et al. | 292/159 |
| 5,171,047 | A | | 12/1992 | Korb et al. | 292/39 |
| 5,373,716 | A | * | 12/1994 | MacNeil et al. | 70/109 |
| 5,782,114 | A | | 7/1998 | Zeus et al. | 70/109 |
| 5,878,606 | A | * | 3/1999 | Chaput et al. | 70/108 |
| 5,906,403 | A | | 5/1999 | Bestler et al. | 292/26 |
| 5,909,919 | A | | 6/1999 | Wang | |
| 6,007,114 | A | | 12/1999 | Hötzl | 292/34 |
| 6,217,087 | B1 | * | 4/2001 | Fuller | 292/39 |
| 6,223,567 | B1 | * | 5/2001 | Fadul | 70/149 |
| 6,257,030 | B1 | | 7/2001 | Davis, III et al. | 70/107 |
| 6,302,456 | B1 | | 10/2001 | Errani | |
| 6,322,113 | B1 | | 11/2001 | Ayers et al. | |
| 6,536,248 | B1 | | 3/2003 | Fan | |
| 6,564,596 | B2 | * | 5/2003 | Huang | 70/107 |
| 6,637,784 | B1 | | 10/2003 | Hauber et al. | 292/300 |
| 6,688,656 | B1 | | 2/2004 | Becken | 292/26 |
| 6,926,315 | B2 | * | 8/2005 | Kondratuk | 292/165 |
| 7,354,081 | B2 | * | 4/2008 | Kondratuk | 292/169 |
| 2003/0106350 | A1 | | 6/2003 | Char et al. | |
| 2003/0106351 | A1 | | 6/2003 | Char et al. | |
| 2003/0192355 | A1 | | 10/2003 | Char et al. | |

* cited by examiner

REVERSIBLE DOUBLE DEADBOLT MORTISE LATCH

FIELD OF INVENTION

This invention relates to a latch bolt assembly for securing a door in a closed and locked position, and more particularly to a reversible double deadbolt mortise latch bolt assembly for such purpose.

BACKGROUND OF THE INVENTION

While primary doors on dwellings provide the principal means or protection against weather and intruders, it has become customary to position a storm door or screen door adjacent to the exterior side of the primary door. Such storm door can protect the primary door from rain, snow, and other harsh elements, thereby prolonging its useful life. Likewise, a storm door or screen door, as the case may be, can allow sunshine and breezes to enter the home when the primary door is left in the open position.

A latch bolt assembly is required on such storm doors and screen doors to secure them in their closed position. Traditionally, such latch bolt has entailed a simple assembly of a pivotable latching arm for engaging a stop located on the door jamb wherein the latching arm is operated by a latch operator on the interior side of the door and a push button and plunger operated from the exterior side of the door. See, e.g., U.S. Pat. No. 4,864,835 issued to Wartian. However, a consumer desire has developed in recent years within the market place for more elegant and substantial storm doors and screen doors that more closely approximate primary doors. In particular, this includes the use of mortise live bolts that are recessed within the interior of the storm door or screen door, and are operated on one side by a rotatable door knob or lever. Such mortise live bolts frequently entail a live bolt retractor and cam sleeve combination that translates the rotary movement of the door knob or lever via a spindle to linear movement to retract the live bolt from a mating hole in the doorjamb to allow the door to be opened. A spring biases the live bolt back to its extended position when external force is removed from the door knob or lever to secure the door in its closed position. See, e.g., U.S. Pat. No. 4,671,089 issued to Fleming et al., and U.S. Pat. No. 6,536,248 issued to Fan.

Because home owners may choose to leave their primary door open on a nice day, an increasing need has arisen for secure locking mechanisms on the storm door or screen door. Such locking mechanisms can also provide a secondary lock for security purposes. The type of locking mechanism traditionally provided with push-button/latch operator door latch assemblies was insufficiently robust. Therefore, the storm door industry is increasingly resorting to deadbolts recessed within the door that are actuated by a key-operated cam. Various deadbolt cam assembly structures are disclosed in U.S. Pat. No. 4,864,835 issued to Wartian and U.S. Pat. No. 6,302,456 issued to Errani, as well as U.S. Published Application No. 2003/0106350A1 filed by Char et al. Such cam assemblies, however, often require a complicated arrangement of interconnecting or interlocking parts for translating the key rotation to linear movement of the deadbolt.

Several other problems arise from the live bolt and deadbolt configuration of latch bolt assemblies commonly used on storm doors or screen doors. First, such live bolts are typically actuated in one direction only—namely by a lever that is rotated downward. The deadbolt is usually positioned below the handle. This means that these latch bolt assemblies must be installed by the manufacturer for custom-designed doors for right vs. left-hand hinge applications. But, this requirement increases inventory costs for the storm door manufacturers and retailers. Alternatively, the pre-installed live bolt may be reoriented, or rotated, by the installer to accommodate right vs. left-hand hinge applications. This requires, however, removal of the mortise plate from the door edge followed by removal, reorientation, and reassembly of the live bolt, handles, spindle, and other associated parts by the installer, which increases installation time and cost at the job site. Simply put, the storm door or screen door cannot be flipped over to convert between right and left-handed hinge applications because these traditional mortise live bolts do not allow for bi-directional handle actuation, and the lock is not symmetrical. Once flipped, the door handle would only function in the upward direction, and the deadbolt lock would be positioned above the handle.

Another limiting constraint on traditional storm doors is the inability to use knobs for handles, because the live bolt actuation is not bi-directional. Yet another difficulty is caused by the rectangular cross section of the deadbolt which requires precise mortising of the mated opening in the doorjamb for receiving the deadbolt. Again, this increases time and cost for the installer. Finally, the structural design of most deadbolt cam operators does not resist the application of excessive force to the end of the deadbolt protrusion that forces the deadbolt to its neutral or retracted position. Therefore, such deadbolts do not function as "true deadbolts" which creates potential security concerns. Likewise, many handle cams in latch bolt assemblies used within the industry cannot accommodate catastrophic loads applied to the handle, which can cause safety problems.

Therefore, it would be advantageous to provide a latch bolt assembly for a door containing bi-directional handle action that can accommodate either knob or lever action, tandem deadbolt actuation symmetrically positioned above and below the live bolt to accommodate vertical inversion during installation of the door for right vs. left-hand hinge application without the need for cumbersome live bolt reorientation, and circular deadbolts that permit simple and quick drilling of the mating holes in the door jamb without the need for precise mortising. Such live bolt and deadbolt components could be preassembled by the manufacturer to enable simple and quick installation of the door at the job site. Moreover, it would be desirable to provide a live bolt assembly that withstands the application of catastrophic forces on the handles, and deadbolts that operate as true deadbolts.

SUMMARY OF THE INVENTION

A reversible, double deadbolt latch bolt assembly for securing and locking a door is provided according to the invention. It comprises a lock body to which is slidably mounted a live bolt for movement between an extended position and a retracted position. Actuation means (e.g., a handle cam rotated by means of a door knob or lever-operated spindle) operatively interacts with the live bolt to move it between the extended and retracted positions. Also slidably mounted to the lock body are at least two cam-operated deadbolts on opposite sides of the live bolt for movement between a locked position and an unlocked position. These cams may optionally be linked to each other within the lock body, so that operation of one of the cams by, e.g., a key cylinder or thumb turn causes simultaneous operation of the other cam.

Because of the symmetrical design and structure of the latch bolt assembly of the present invention, it enables a door into which it is inserted to be installed for both left-hand and right-hand hinged applications by mere flipping of the door by the installer without the need to remove the latch bolt assembly in order to further remove and invert the live bolt contained therein, as is customary within the industry. This feature greatly simplifies installation of the door. Alternatively, a bidirectional actuator for the live bolt can be used in conjunction with a single deadbolt, such combination still permitting the door to be flipped to accommodate both left-hand and right-hand hinged applications of a door during installation.

Not only does the double deadbolt provide added security, but also it enables the corresponding key cylinder and thumb turn on the exterior and interior sides of the door, respectively, to be installed both below, or one below and the other above, the handles to provide greater aesthetic flexibility. Moreover, the deadbolts of the present invention are designed in such a manner to provide "true deadbolt" functionality against excessive force applied to the protruding end of the deadbolt by, e.g., an intruder. The latch bolt assembly likewise provides means for limiting the travel of the handle cam in response to excessive force applied to the handle as a safety measure.

DETAILED DESCRIPTION OF THE PREFERRED EMBODIMENT

A door comprising a reversible, double deadbolt latch mechanism that can be readily flipped for easy right-hand and left-hand hinged installations without complicated and time-consuming steps conducted by the installer, and which provides unsurpassed security, safety, and aesthetic flexibility is provided by the invention. Such invention may take the form of a mortised latch mechanism that is symmetrically oriented with identical deadbolts located above and below a live bolt, and wherein the live bolt and deadbolt assemblies are designed to withstand the unforeseen application of catastrophic levels of force.

Figure 1:
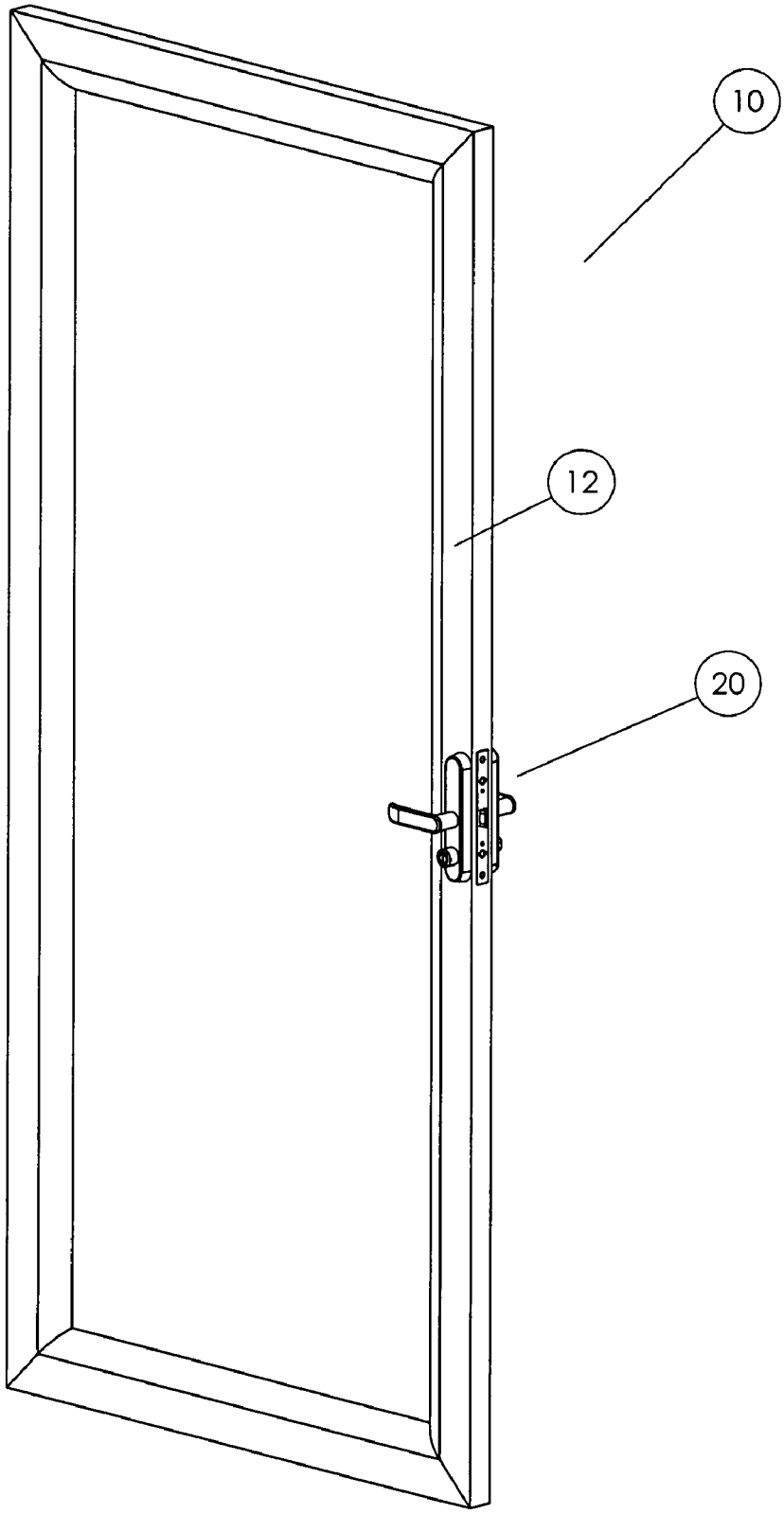
FIG. 1 is an isometric exterior view of a door with the latch system mounted thereto.
Figure 2:
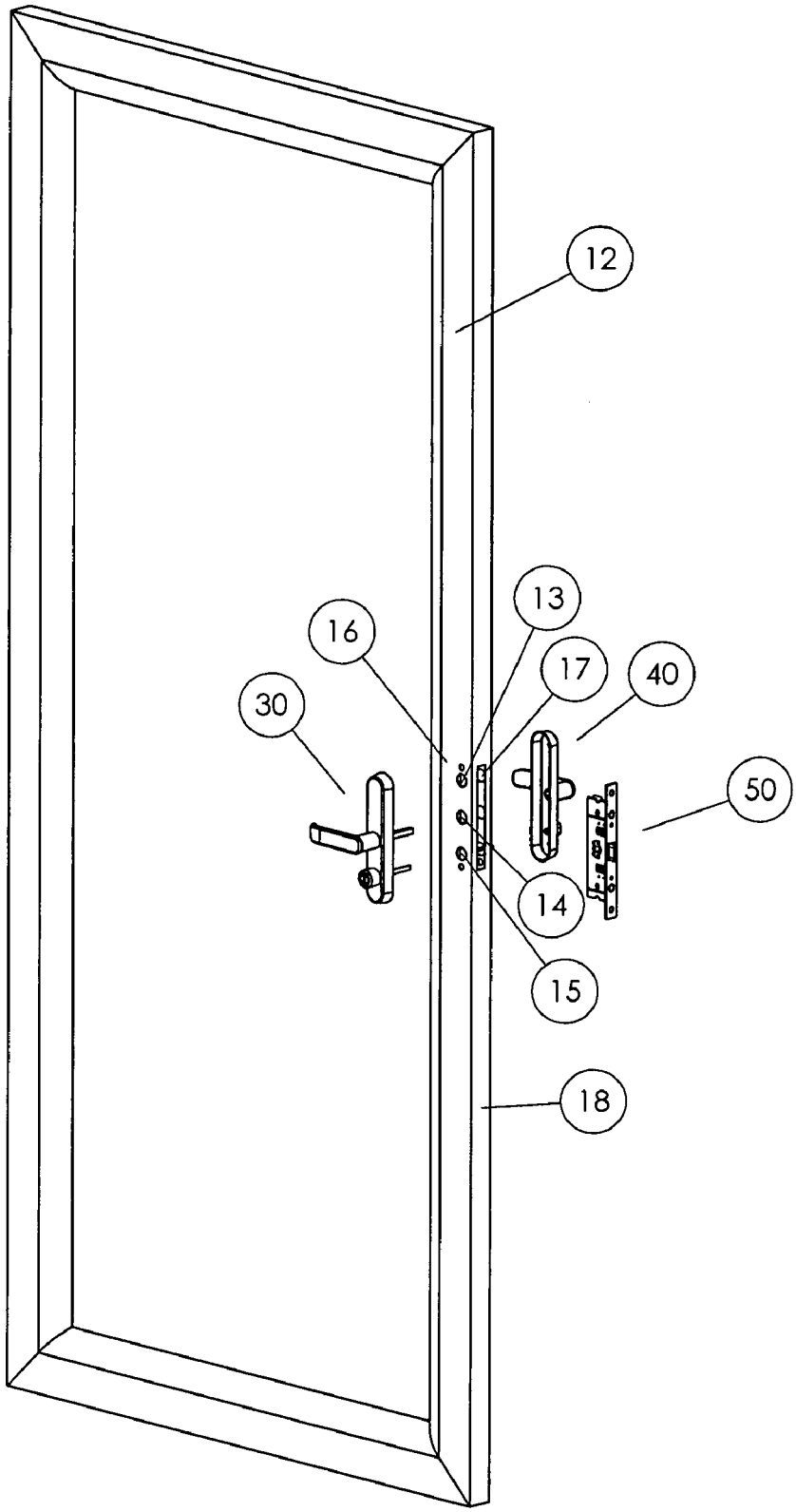
FIG. 2 is an exploded isometric view of a door with the latch system.

FIG. 1 shows a typical door assembly 10 of the present invention for which a latch system 20 is secured to the door 12. More particularly, as show in FIG. 2, axially aligned holes 13, 14, and 15 positioned through door face 16 accommodate exterior escutcheon plate assembly 30 and interior escutcheon plate assembly 40 as described more fully herein. Likewise, mortised opening 17 in door edge 18 accommodates latch mechanism 50.

For purposes of the present invention, "door" means any door of a house, office, store, or other dwelling or building that provides ingress or egress to the dwelling or building, or a room contained therein, and provides some measure of security or safety against exterior or interior intruders or elements. Such door includes, but is not limited to, primary doors, man doors, storm doors, and screen doors. Such doors may be manufactured from any suitable material including wood, metal, plastic or composite resins.

Figure 3:
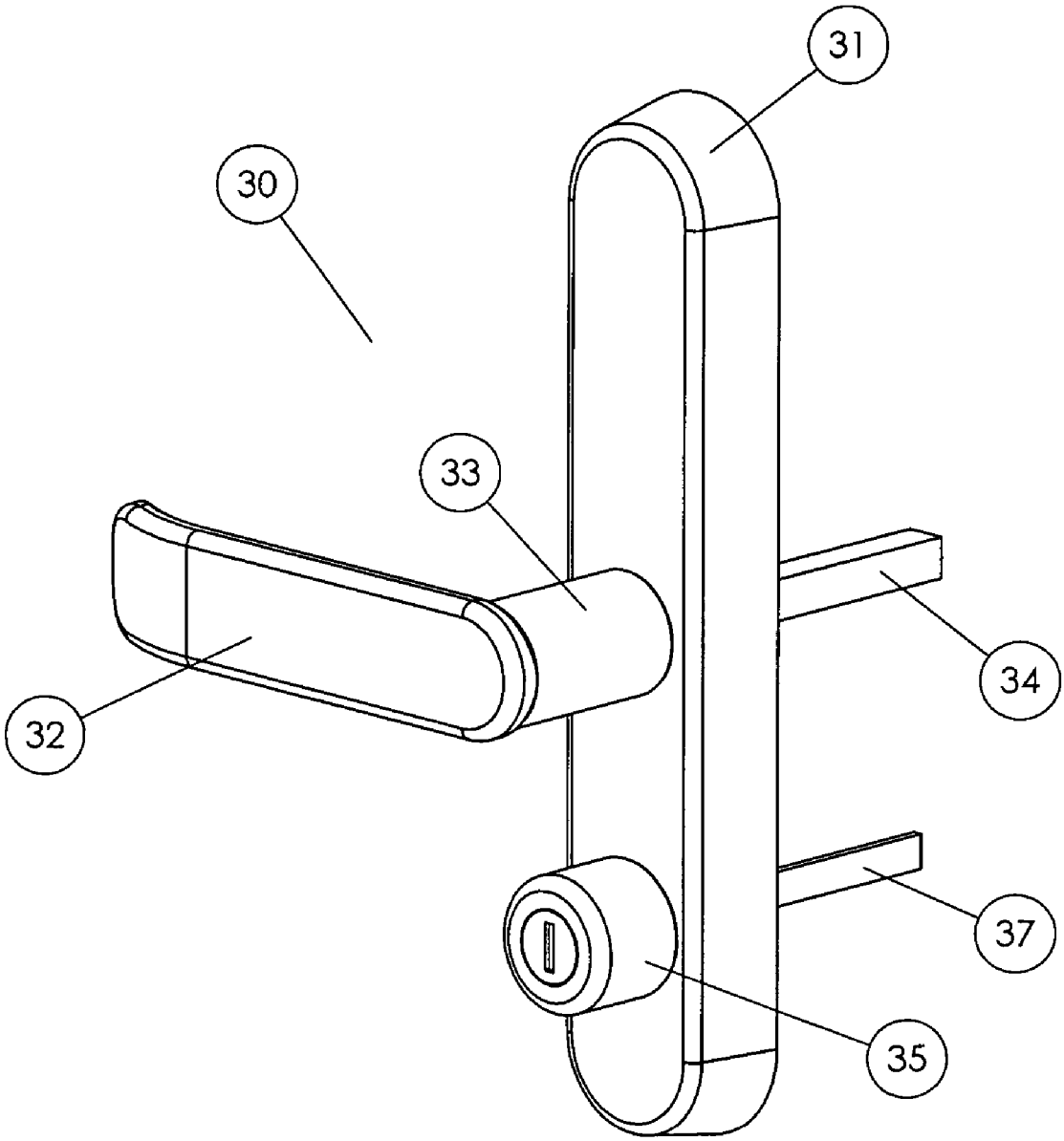
FIG. 3 is an isometric view of the outward facing side of the exterior escutcheon assembly.
Figure 4:
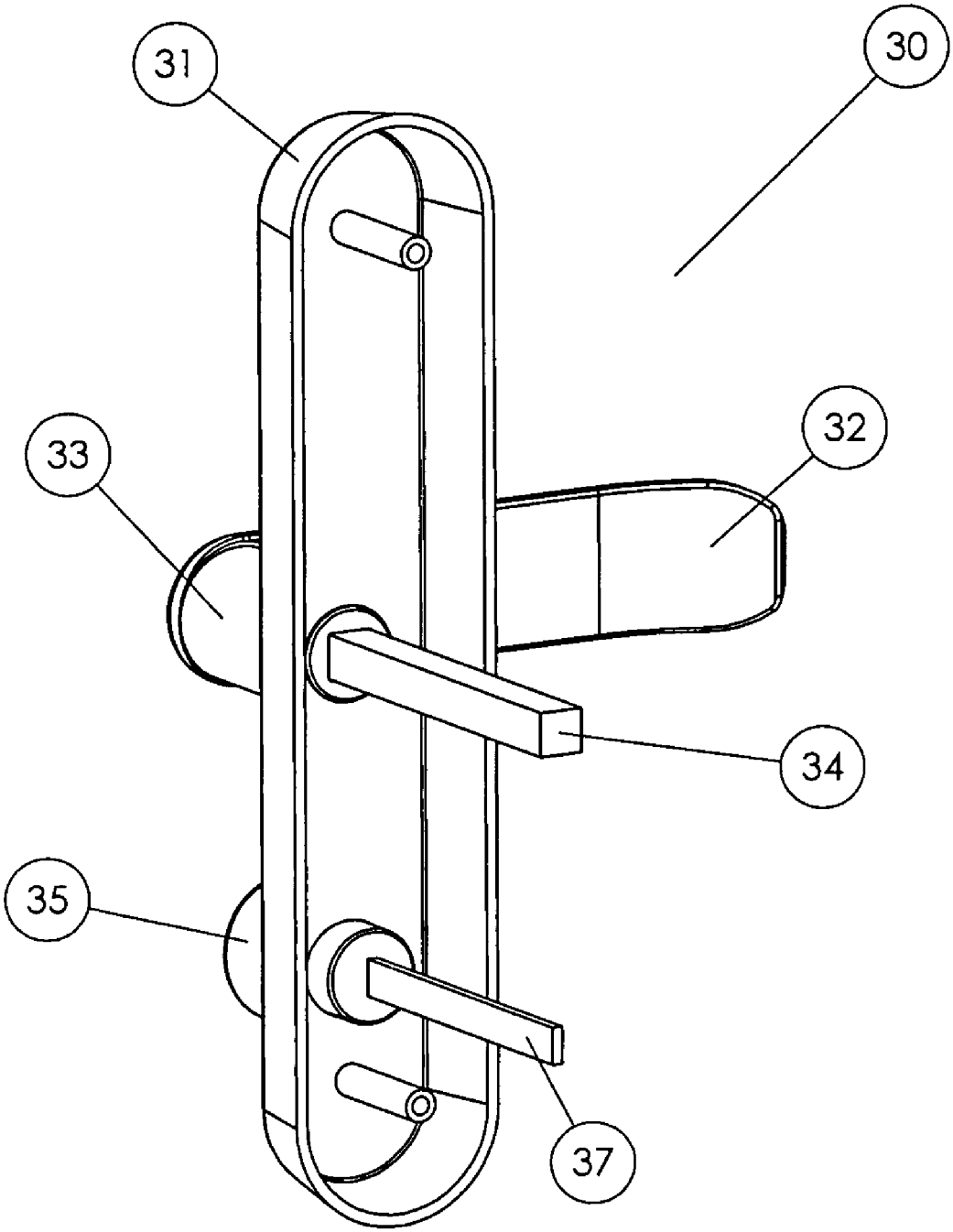
FIG. 4 is an isometric view of the inward facing side of the exterior escutcheon assembly of FIG. 3.

FIGS. 3-4 illustrate the exterior escutcheon plate assembly 30 of the present invention. It comprises escutcheon plate 31 to which is secured exterior handle 32 with handle spindle 34 inserted into a hole in the boss portion 33 of the handle 32. Key cylinder 35, in turn, is secured to escutcheon plate 31 with key cylinder spindle 37 inserted into a hole in the distal end of the key cylinder 35. In this manner, handle spindle 34 and cylinder spindle 37 extend through escutcheon plate 31 for engagement with latch bolt assembly 50, as described below.

Figure 5:
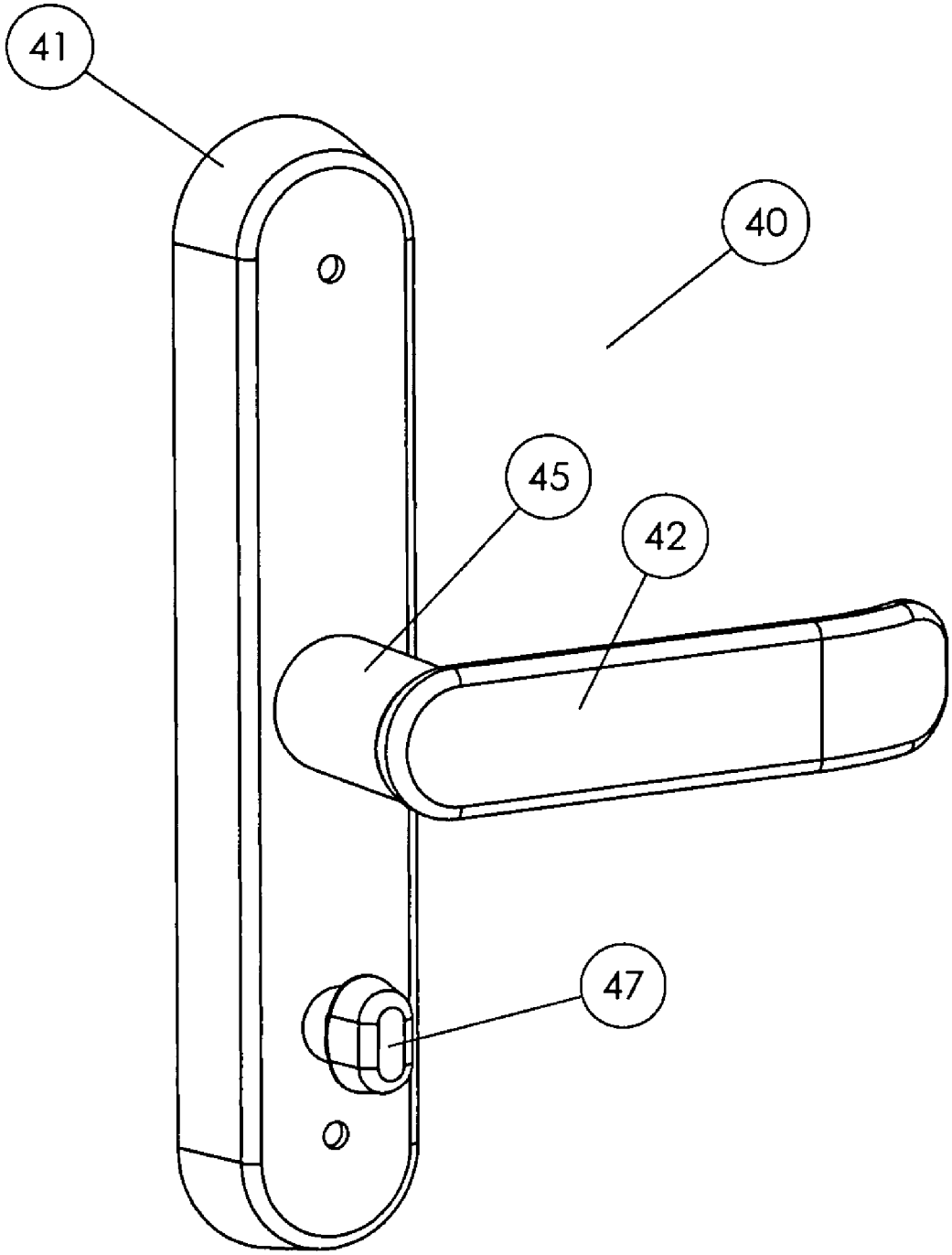
FIG. 5 is an isometric view of the outward facing side of the interior escutcheon assembly.
Figure 6:
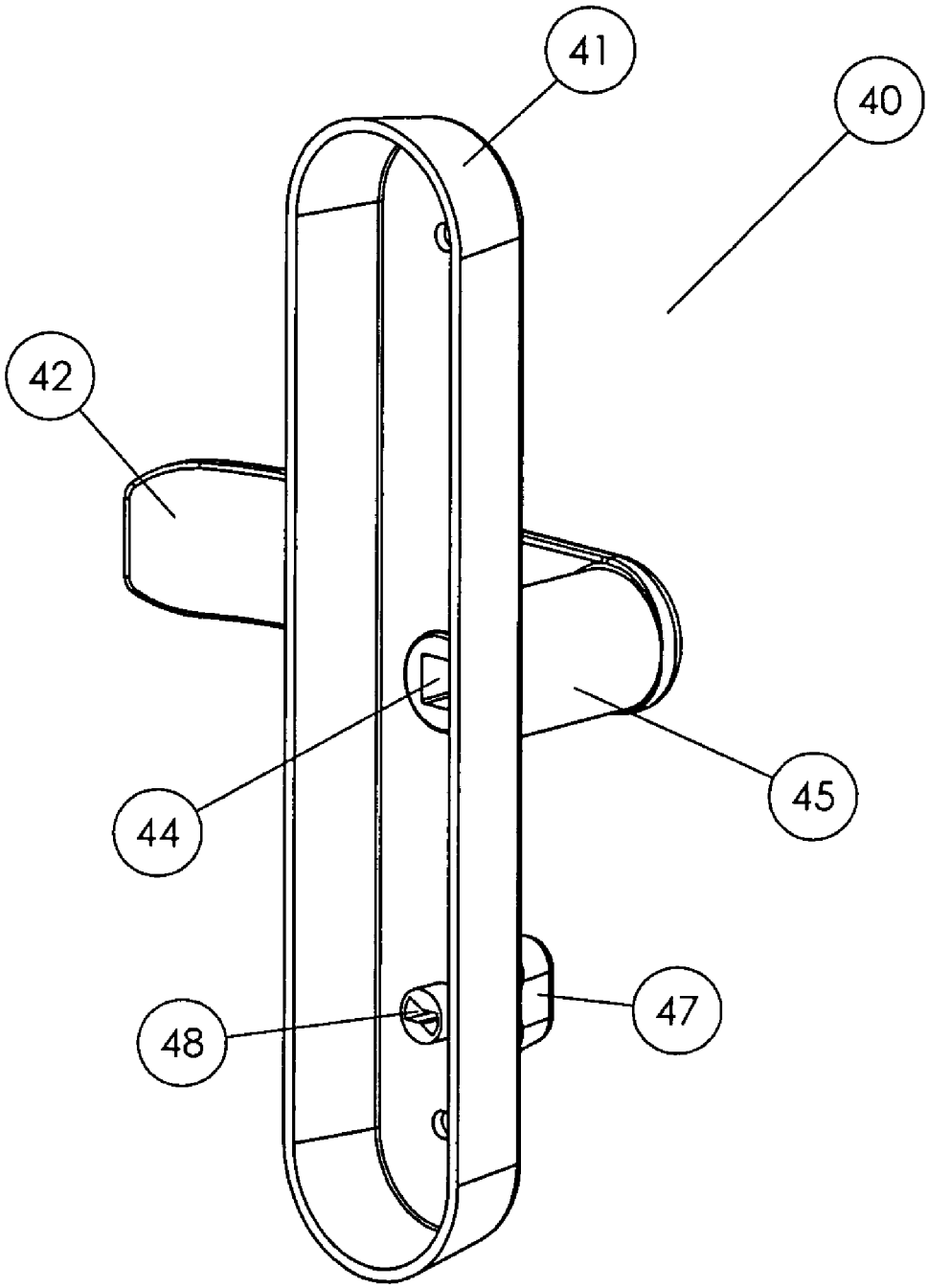
FIG. 6 is an isometric view of the inward facing side of the interior escutcheon assembly of FIG. 5.

FIGS. 5-6 show the structure of the interior escutcheon plate assembly 40 of the present invention. It comprises escutcheon plate 41 to which is secured interior inside handle 42. Opening 44 is located in the distal end of the boss portion 45 of handle 42 for purposes of receiving the other end of handle spindle 34, as described more fully below. Meanwhile, thumb turn 47 is secured to the escutcheon plate 41, and has slotted opening 48 in its distal end for receiving the other end of cylinder spindle 37.

Figure 7:
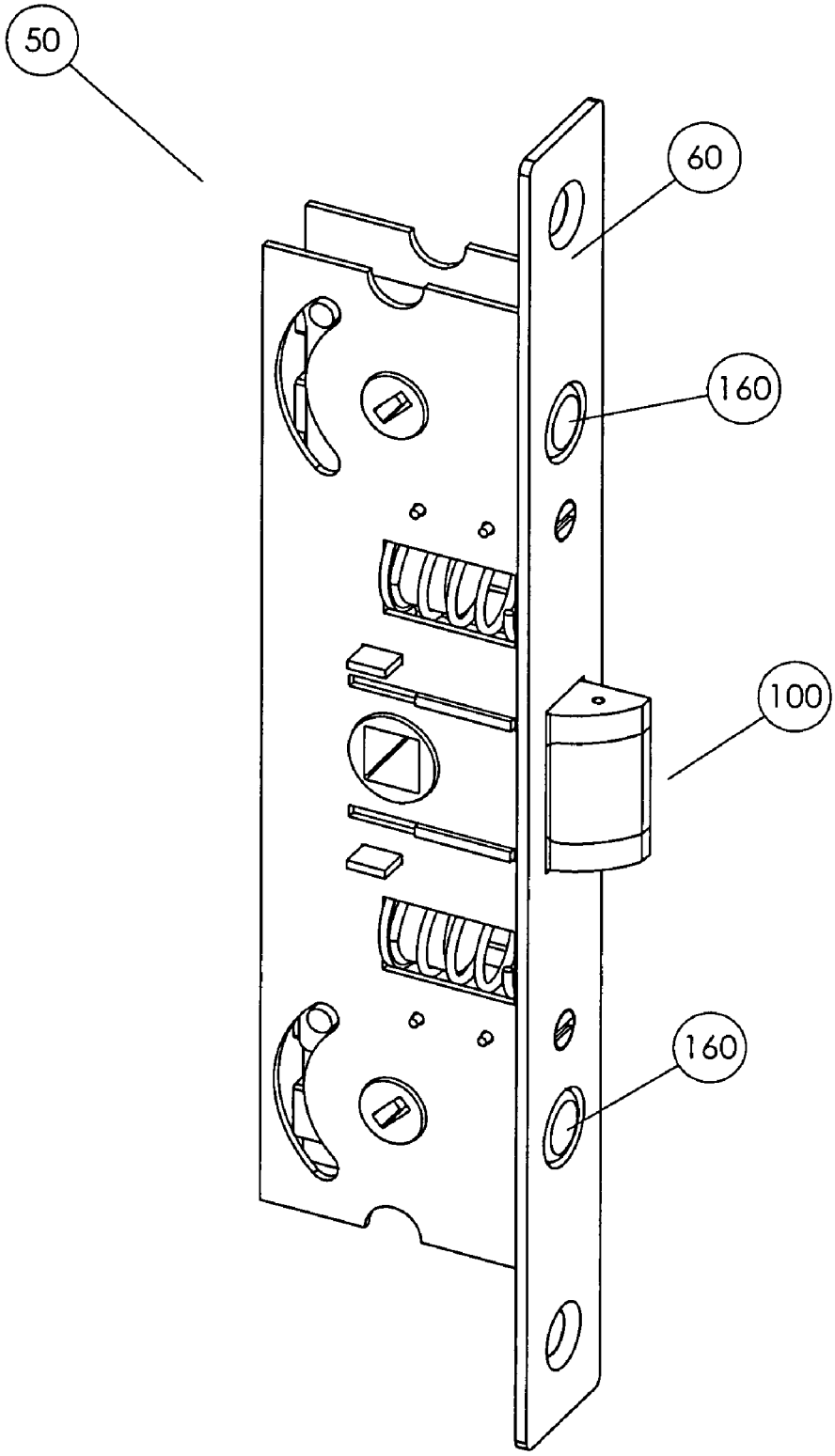
FIG. 7 is an isometric view of the latch bolt assembly in a neutral, unlocked position, with the live bolt extended.
Figure 8:
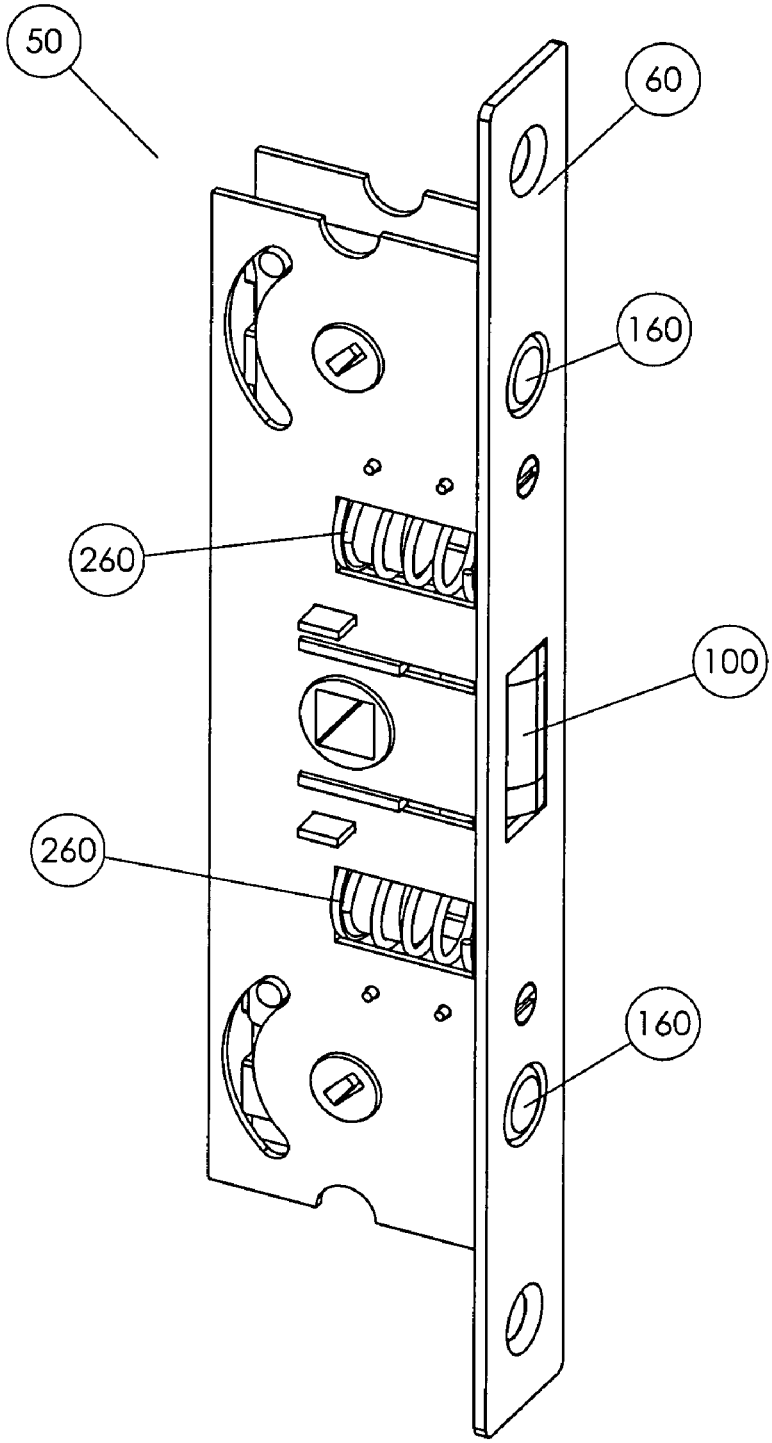
FIG. 8 is an isometric view of the latch bolt assembly in an unlocked position, with the live bolt retracted.
Figure 9:
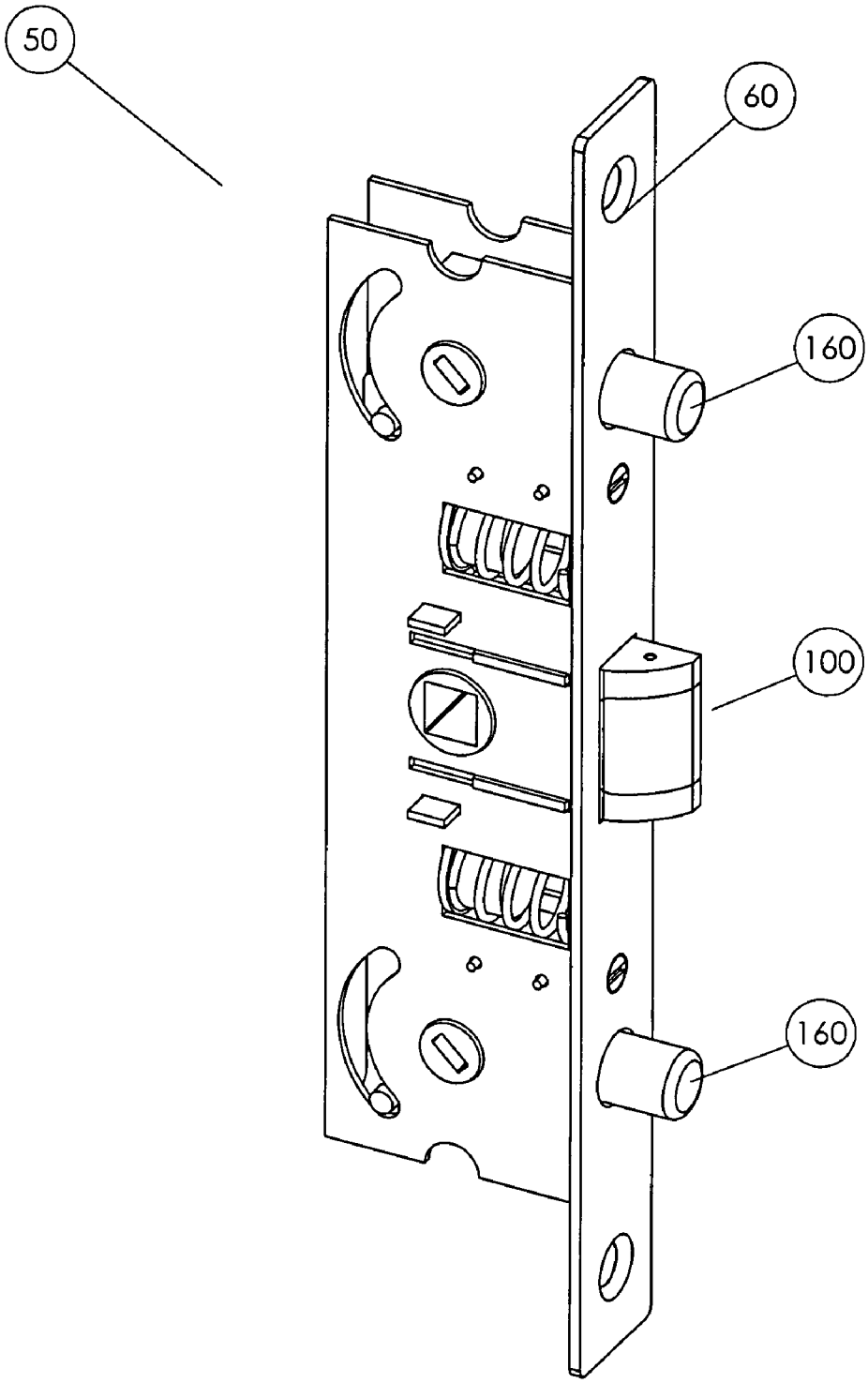
FIG. 9 is an isometric view of the latch bolt assembly in a neutral, locked position.

FIGS. 7-9 show latch bolt assembly 50 in a variety of operative positions. In FIG. 7, live bolt 100 is in the extended position, while deadbolts 160 are in their retracted position. When in this position, door 12 will be in a secured, but unlocked condition. In FIG. 8, meanwhile, live bolt 100 has been retracted and deadbolts 160 likewise are in their retracted position. When in this position, door 12 may be readily pulled or pushed open by means of handles 32 or 42. Finally, in FIG. 9, live bolt 100 and deadbolts 160 are all in their extended position. When in this position, door 12 is in a secured and locked condition, and may not be pulled or pushed open even if live bolt 100 is subsequently retracted.

Figure 10:
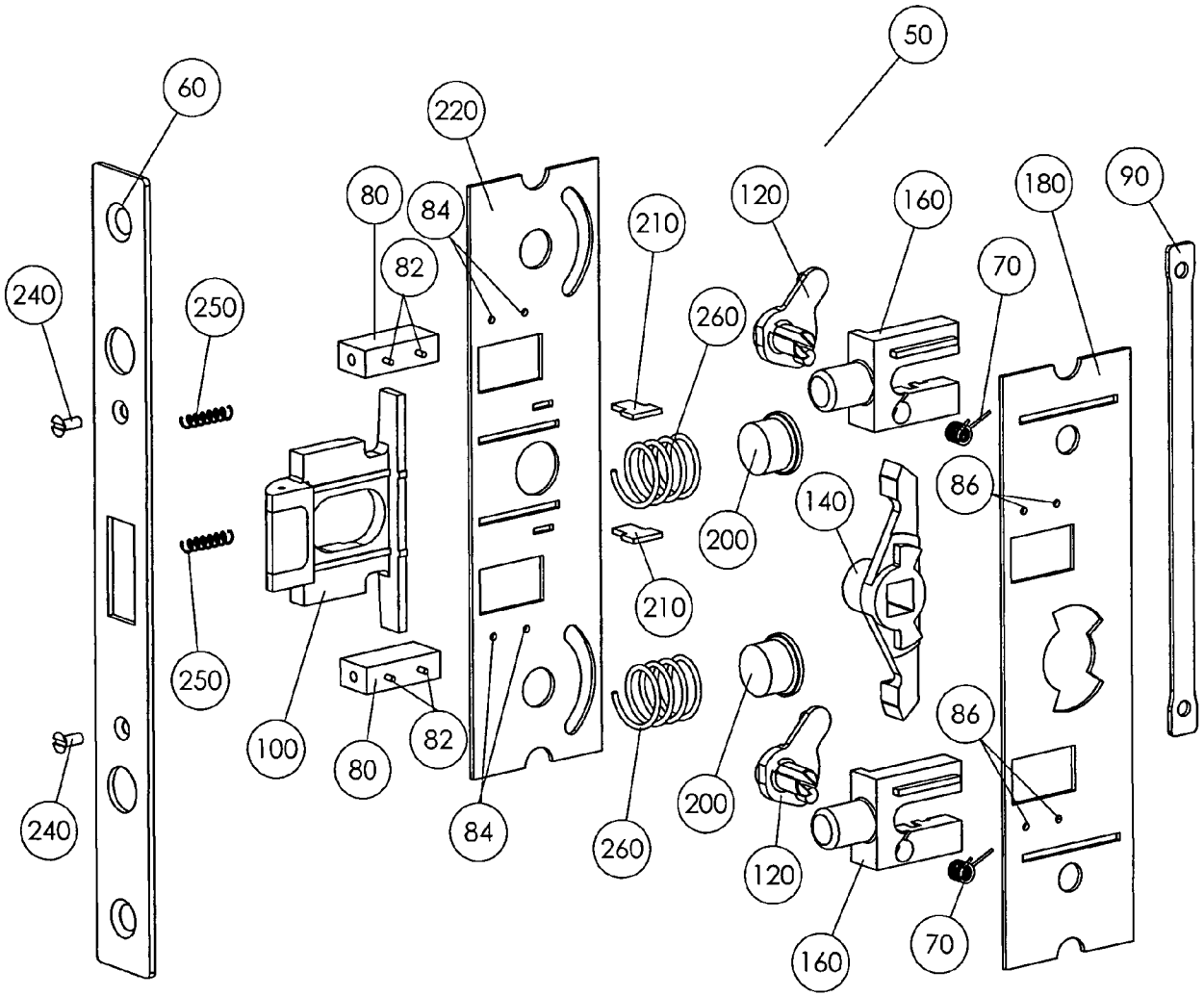
FIG. 10 is an isometric exploded view of the latch bolt assembly.
Figure 11:
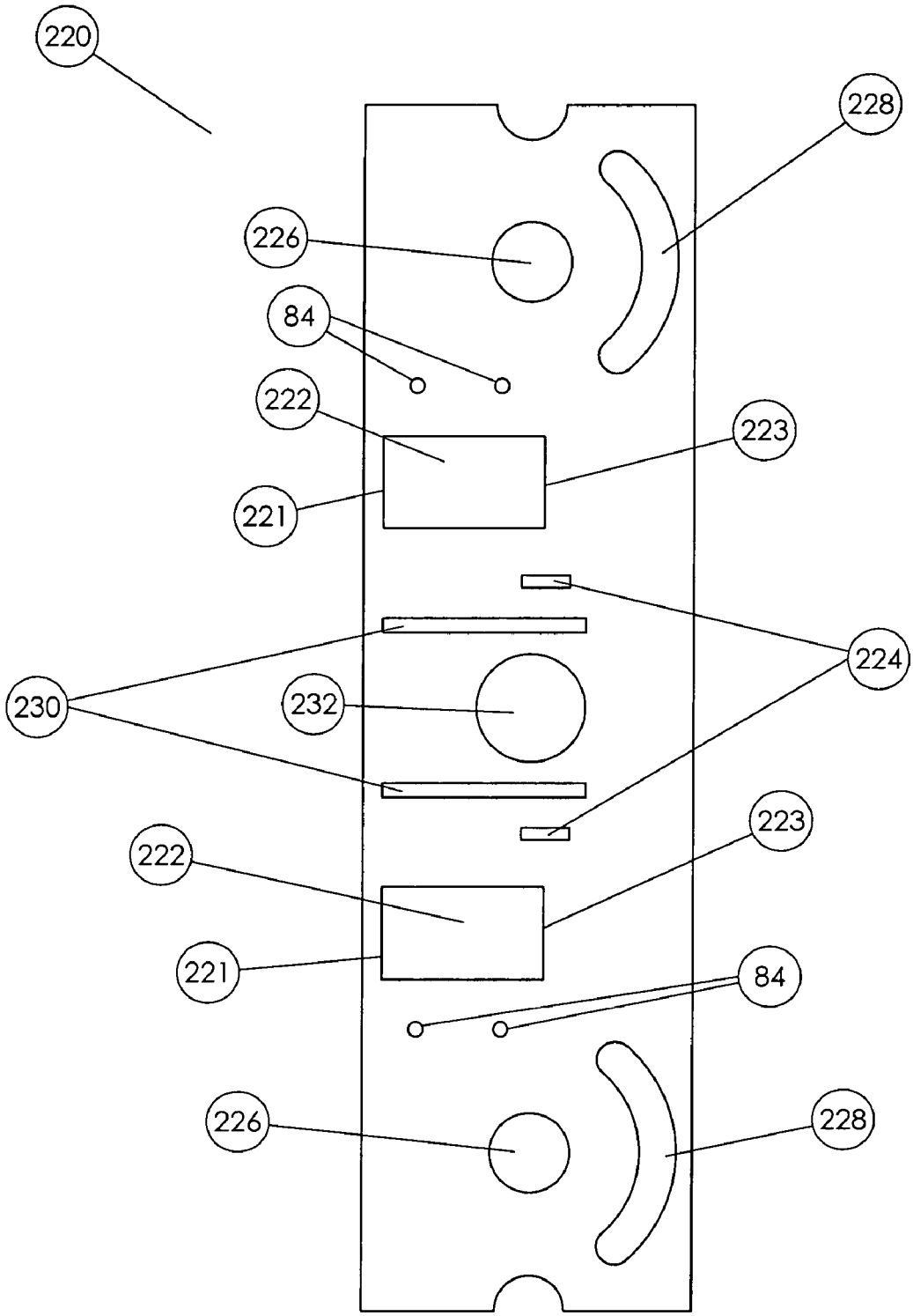
FIG. 11 is a side view of the top plate.
Figure 12:
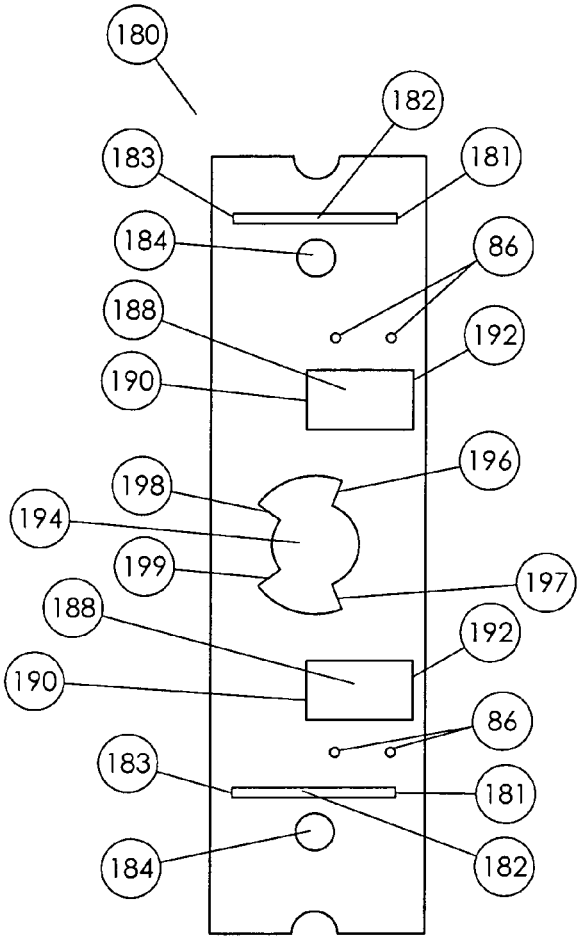
FIG. 12 is a side view of the stop plate.

FIG. 10 illustrates the individual components of latch bolt assembly 50 in an exploded view. It comprises top plate 220 and stop plate 180 which are held in parallel spaced alignment by means of blocks 80 which have pins 82 extending from opposite sides for engaging holes 84 and 86, respectively, in top plate 220 and stop plate 180. Top plate 220 is shown in greater detail in FIG. 11. Stop plate 180 is shown in greater detail in FIG. 12. Relief holes 232 and 194, respectively, receive the handle spindle 34 that extends from the two handles to actuate the live bolt mechanism.

Figure 13:
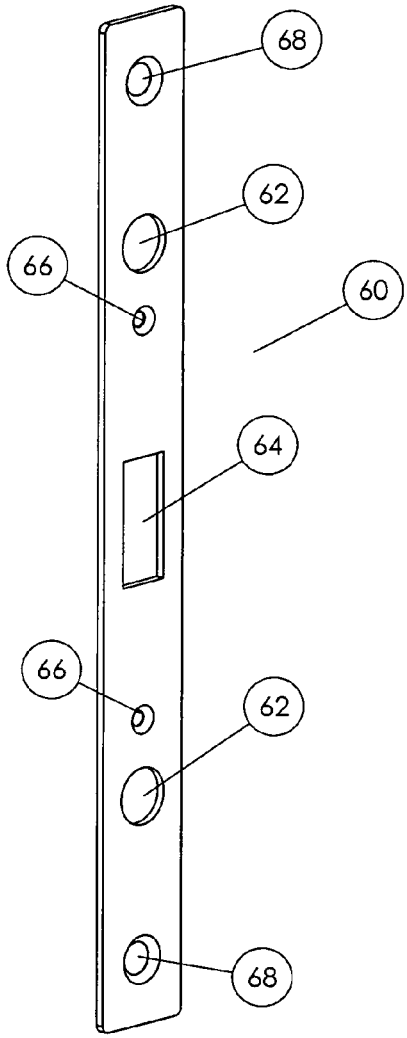
FIG. 13 is an isometric view of the mortise plate.

Mortise plate 60, which is shown more discretely in FIG. 13, has stamped or machined therein deadbolt reliefs 62, live bolt relief 64, screw relief 66, and mounting holes 68. Mortise plate 60 is secured to blocks 80 by means of bolts 240 to form the third side of latch bolt assembly 50. Screws (not shown) may be used to secure mortise plate 60 to a slot mortised in edge 18 of door 12, as is known in the art.

Figure 14:
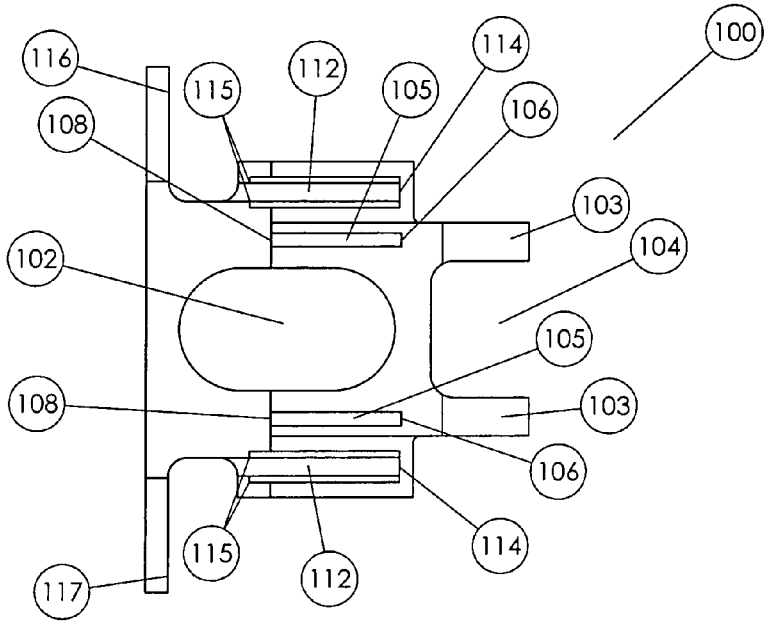
FIG. 14 is a side view of one side of the live bolt.
Figure 15:
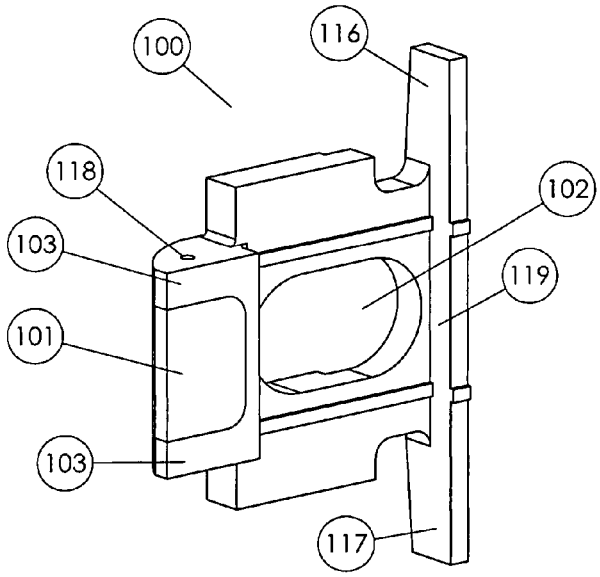
FIG. 15 is an isometric view of the opposite side of the live bolt of FIG. 14.

Live bolt 100 is shown in greater detail in FIGS. 14-15. It entails a body having an elongated opening 102 for receiving handle spindle 34 and handle cam 140, as discussed more fully below. Extending from a first end are prongs 103 that define a space 104 for receiving latch tip insert receiver 101 that defines the latch that extends through live bolt relief 64 (see FIG. 11). Latch tip insert receiver 101 is made from low-friction plastic material, and is secured to prongs 103 by means of pins (not shown) inserted through holes 118 in the prongs. It should be noted that prongs 103 and receiving insert receiver 101 could alternatively be formed as a single, integral unit to form the latch. Live bolt 100 may be made from zinc, steel, plastic, or any other suitable material.

Extending from the opposite end of live bolt 100 are first translation surface 116 and second translation surface 117 with neutral plane 119 defined therebetween. Two bolt ribs 105 extend laterally from the one face of live bolt 100, terminating at each end in extension stop 106 and retracting stop 108. These bolt ribs slidably engage bolt guide track 230 located on top plate 220 (See FIG. 11) to secure live bolt 100 in proper orientation with respect to live bolt relief 64 in mortise plate 60 and the mating mortised hole made in the doorjamb or Z-bar secured to the doorjamb.

Figure 16:
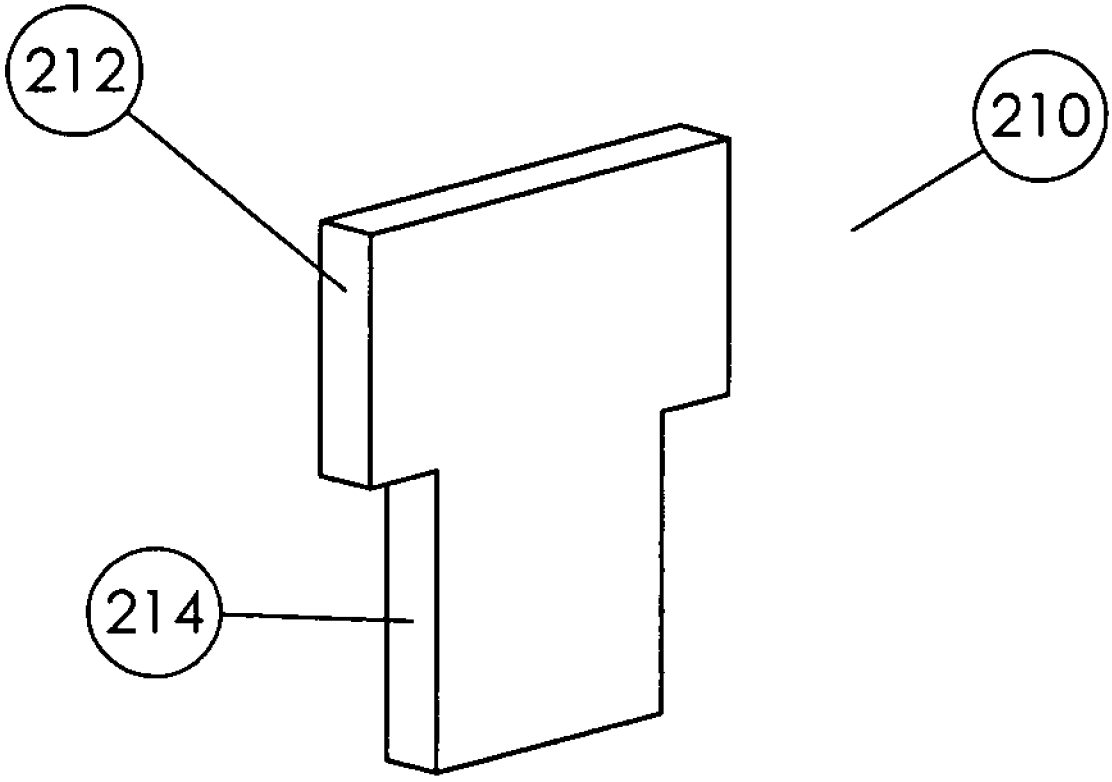
FIG. 16 is an isometric view of a spring support.

Live bolt springs 250 retained in live bolt spring cavity 112 formed in live bolt 100 between live bolt spring supports 114 on live bolt 100, and spring abutment 212 provided by support 210 (see FIG. 16) that is secured in spring abutment hole 224 of top plate 220 (see FIG. 11) act to help bias live bolt 100 to its extended position with extension stops 106 abutting the forward end of bolt guide track 230 as live bolt 100 slides within the housing of mortise latch bolt assembly 50 to limit the degree of extension of the live bolt. Meanwhile, retraction stop 108 of bolt ribs 105 abut the rearward ends of bolt guide tracks 230 as the live bolt slides backward within the housing of latch mechanism 50 to limit the rearward travel of the live bolt 100 during retraction.

Figure 17:
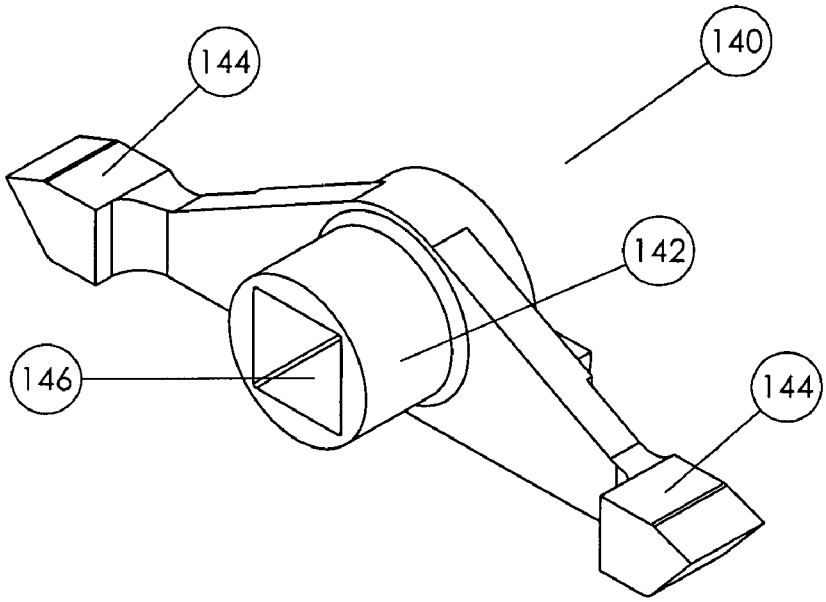
FIG. 17 is an isometric view of the handle cam.
Figure 18:
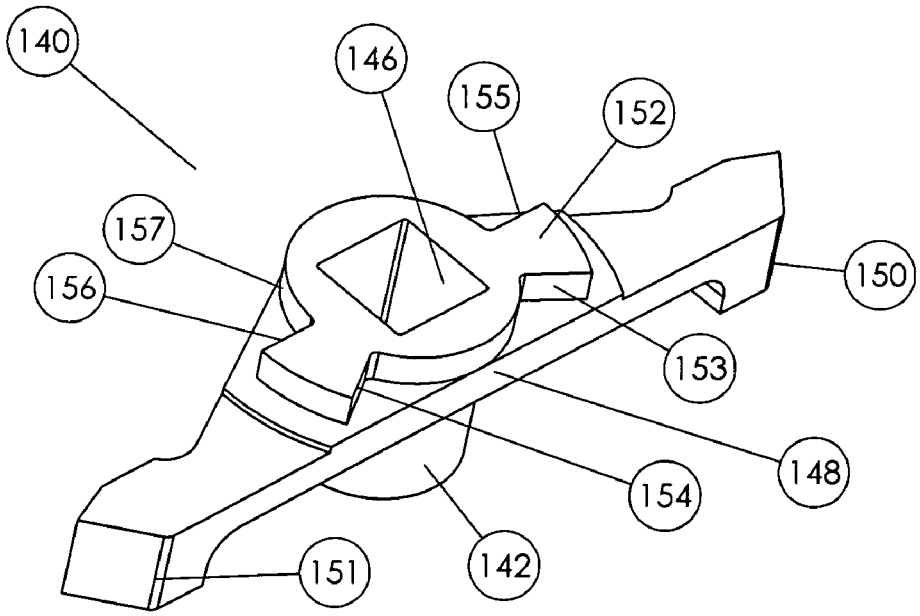
FIG. 18 is an isometric view of the opposite side of the handle cam of FIG. 17.

FIGS. 17-18 show handle cam 140 in greater detail. Shaft 142 extends from one face of the handle cam 140, and has a hole 146 therethrough for receiving handle spindle 34. While hole 146 is illustrated as being square-shaped in the drawings, it could readily adopt a variety of other shapes like rectangular, hexagonal, or octagonal, as long as the handle spindle bears a similar cross-sectional shape and size. Extending laterally along handle cam 140 are first bolt cam 150 and second bolt cam 151, which in turn provide abutting surfaces 144 along their rearward lateral edge. Extending from the face of handle cam 140 opposite to shaft 142 is key 152 with two wings that define lateral edges constituting first stop A 153, first stop B 154, second stop A 155, and second stop B 156.

Figure 19:
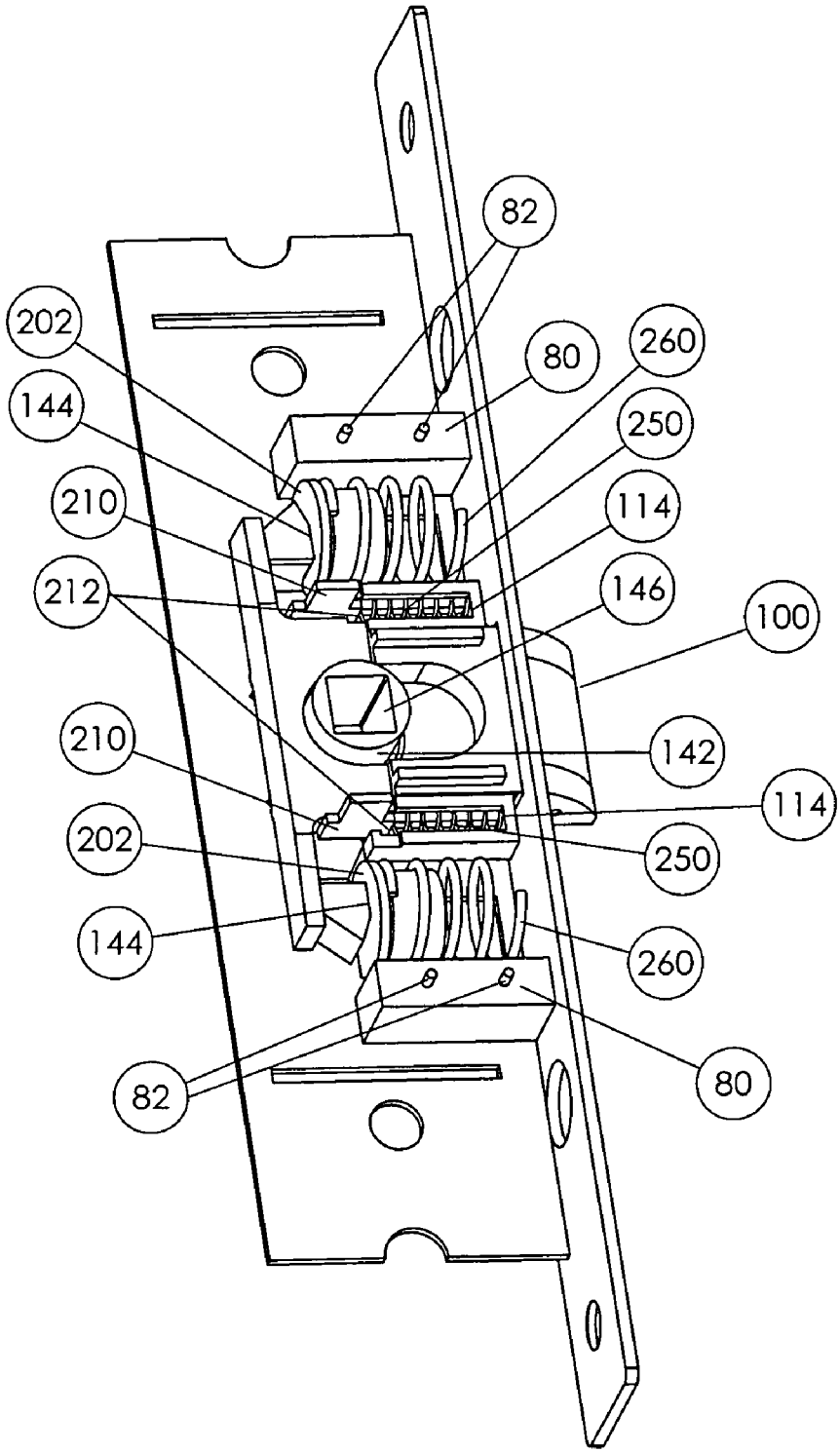
FIG. 19 is an isometric view of the latch bolt assembly with the live bolt in the neutral position and with the top plate, deadbolts, deadbolt cams, deadbolt springs, and link removed.

Actuation of live bolt 100 will now be described with the assistance of FIGS. 19-21 in which the deadbolts, deadbolt cams, linkage, and deadbolt springs have been removed for the sake of clarity. In FIG. 19, live bolt 100 is in the extended or neutral position. In this position, handle cam 140 resides in the neutral position, which is somewhat vertical with respect to the latch. In the neutral position, handle cam 140 is balanced by the two handle springs 260 with equal loading. The handle springs are supported by the perimeter edges of handle spring reliefs 222 in top plate between home side 223 and stop side 221, and handle spring relief 188 in stop plate 180 between home side 190 and stop side 192. These springs maintain the handle cam in an unbiased, neutral position. Live bolt 100, in turn, is biased to its extended position by means of live bolt springs 250. As shown, the live bolt springs are constrained between supports 210 that are secured in slots 224 in top plate 220 (more specifically spring abutments 212) and live bolt spring support 114. This results in balanced spring extension force being applied to live bolt 100. It should be noted that handle spindle receiver 146 of handle cam 140 is squarely positioned relative to the live bolt 100, which maintains handles 32 and 42 in their neutral position via handle spindle 34, regardless of whether live bolt 100 is used as shown in the drawings, or inverted 180° with respect to the longitudinal axis of live bolt 100.

Figure 20:
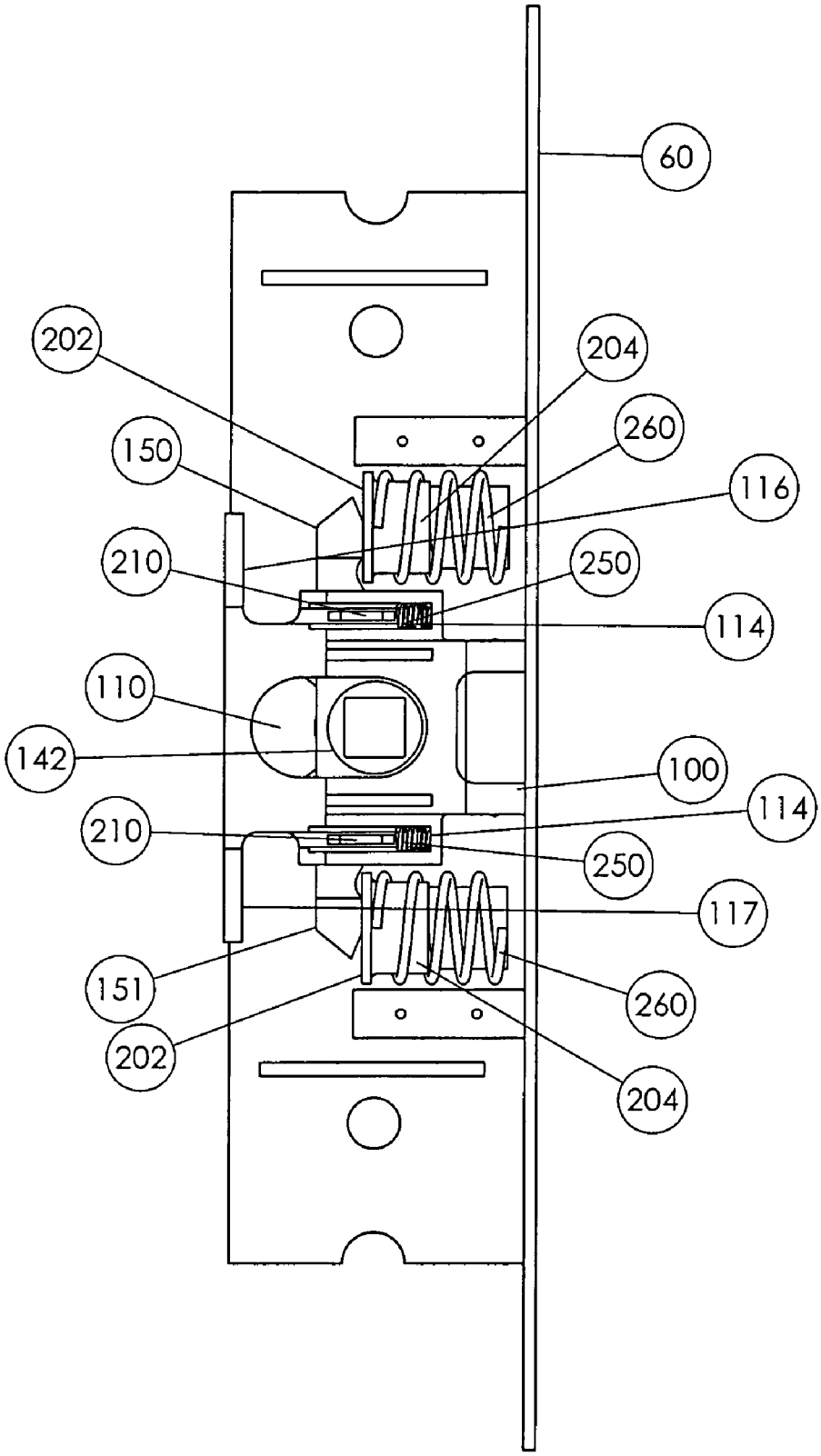
FIG. 20 is a side view of the latch bolt assembly in the "closing" position with the top plate, deadbolts, deadbolt cams, deadbolt springs, and link removed.

In FIG. 20, the same live bolt 100 is shown, but in the "closing" position in which the live bolt 100 is retracted as if the door were closing. In this situation, the tip of live bolt 100 has been pushed into the housing of latch mechanism 50 when it engaged the strike plate on the doorjamb or Z-bar secured to such doorjamb. Live bolt springs 250 have become compressed resulting in a larger biasing force toward live bolt extension. Meanwhile, handle cam 140 and handle springs 260 remain in their neutral positions. Once the door is closed so that the tip of live bolt 100 has traveled across the solid portion of a strike plate, live bolt springs 250 will bias the live bolt 100 once again to its extended position, as shown in FIG. 19, and the tip of live bolt 100 enter the mortised latch hole in the door jamb or Z-bar secured to such door jamb.

Figure 21:
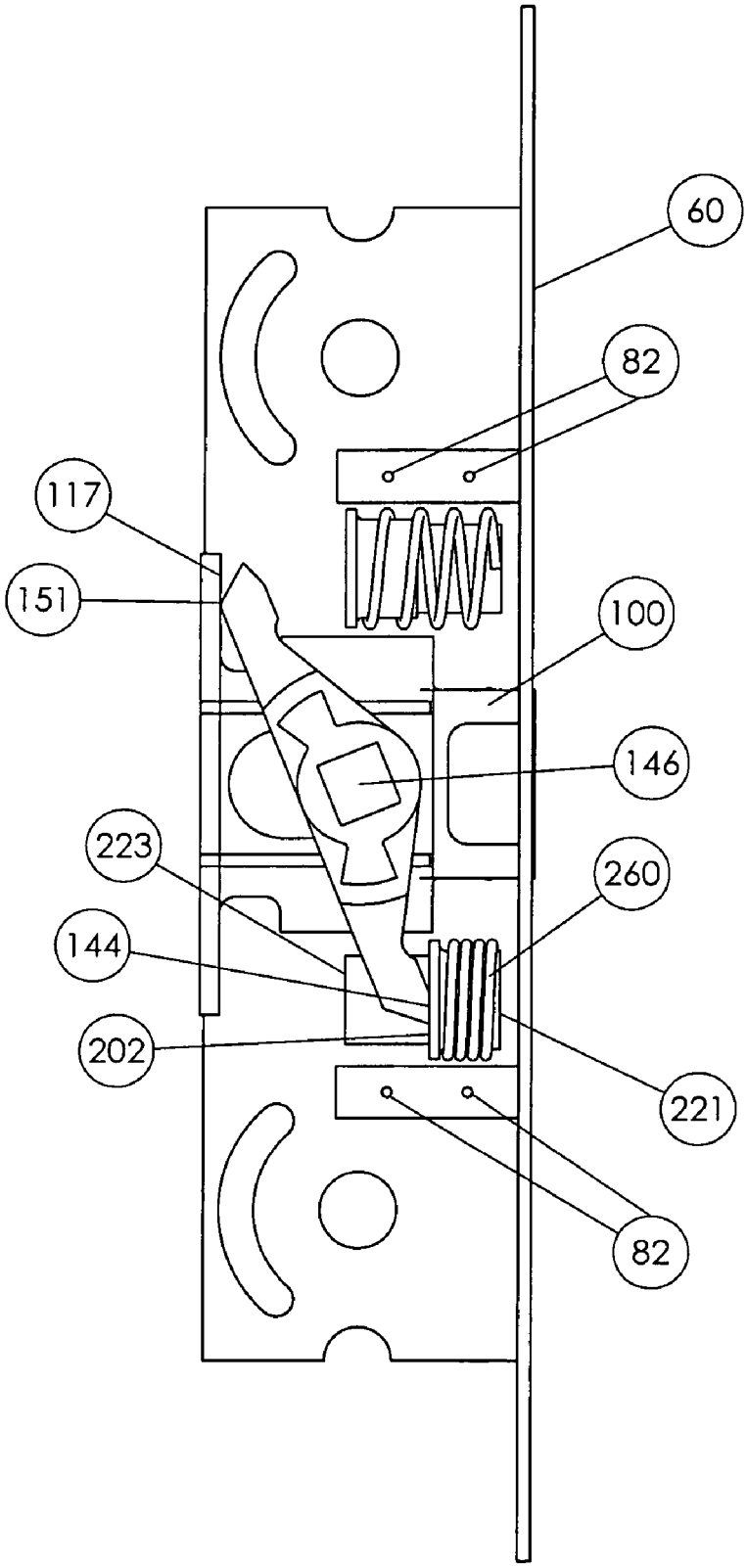
FIG. 21 is a side view of the latch bolt assembly with the handle rotated and with the top plate, deadbolts, deadbolt cams, deadbolt springs, and link removed.
Figure 22:
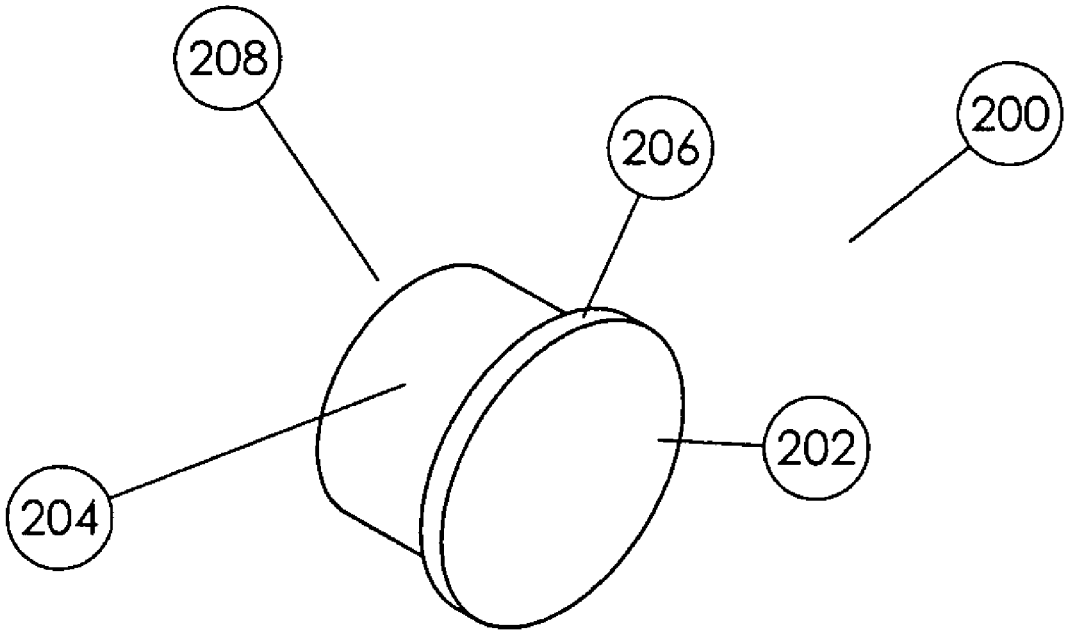
FIG. 22 is an isometric view of the cap.

FIG. 21 shows the latch bolt in the "rotated" configuration. Handle 32 or 42 has been rotated in a downward direction. This rotational force is translated via handle spindle 34 to handle cam 140, resulting in compression of the lower handle spring 260 by means of abutting surface 144 of first bolt cam 150. This, in turn, applies a biasing moment to the actuation lever from the compressed handle spring 260. The handle spring 260 is constrained between and within stop plate 180 and top plate 220, namely by spring relief 188 and 222, respectively (see FIGS. 11 and 12). The spring 260 is constrained by the handle spring stops 192 and 221, respectively. Cap 200 (see FIG. 22) acts as a piston within handle spring 260 by providing a positive surface for the abutting surface 144 of handle cam 140 to act upon. Cap stem 204 (see FIG. 21) resides inserted within the inner diameter of handle spring 260, but abuts the spring end. Thus, when sufficient force is applied to the cap 200, the handle spring is further compressed.

At the same time, the neutral plane position 148 of second bolt cam 151 will be rotated until it abuts first translation surface 117 of live bolt 100. In so doing, it pushes live bolt 100 to its retracted position, as shown in FIG. 21. Once the torque applied to the handle 32 or 42 and handle cam 140 about the spindle axis is removed, the compressed handle spring 260 biases cap 200 and handle cam first bolt cam 150 back to the neutral handle cam position shown in FIG. 19.

Figure 23:
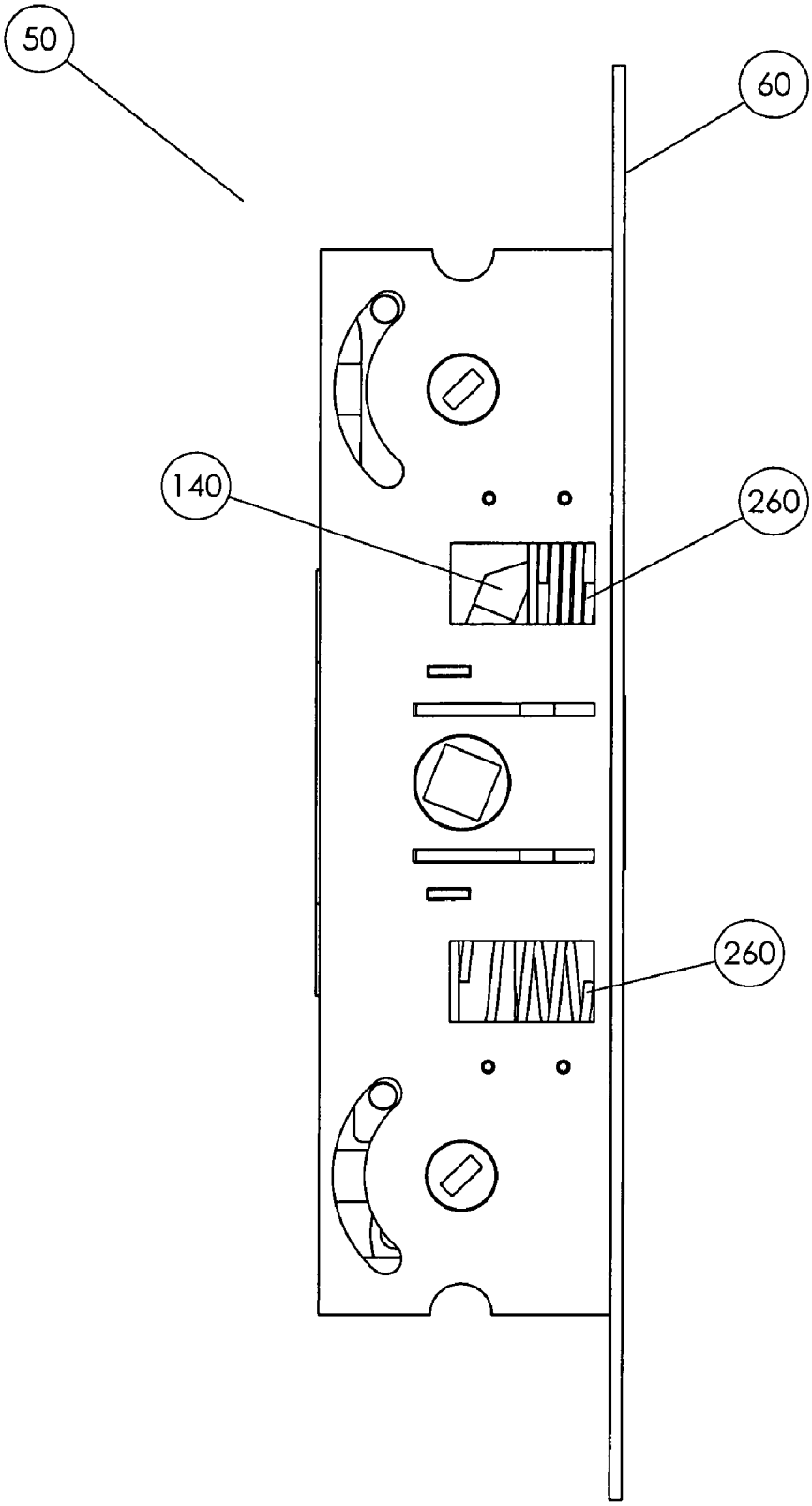
FIG. 23 is a side view of the latch bolt assembly in an unlocked position, with the live bolt retracted.

It should be apparent that the symmetrical design of latch mechanism 50 will cause live bolt 100 to be retracted in a similar manner if rotation of handle 32 or 42 causes handle cam 140 to rotate in the opposite direction (see FIG. 23). In this case the other handle spring 260 will be compressed by second bolt cam 151, and first bolt cam 150 will abut second translation surface 117 of live bolt 100 to push the latch to its retracted position. This feature of the present invention is important, since it enables the use of door knobs that may be rotated in either direction, allows door levers to be pushed down or up to retract live bolt 100 in accordance with operator preference, and, most importantly, enables the door to be flipped to accommodate right or left-hand hinged installations without any need to rotate latch mechanism 50 by the installer.

Figure 24:
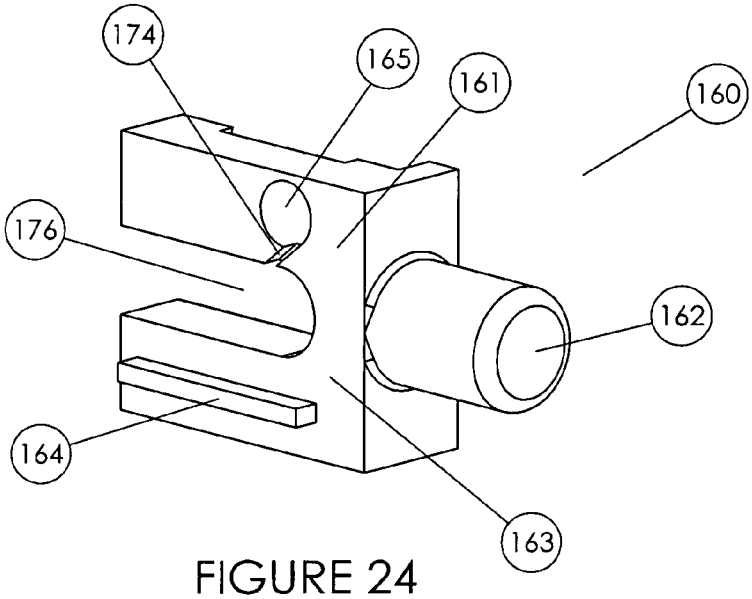
FIG. 24 is an isometric view of a deadbolt.
Figure 25:
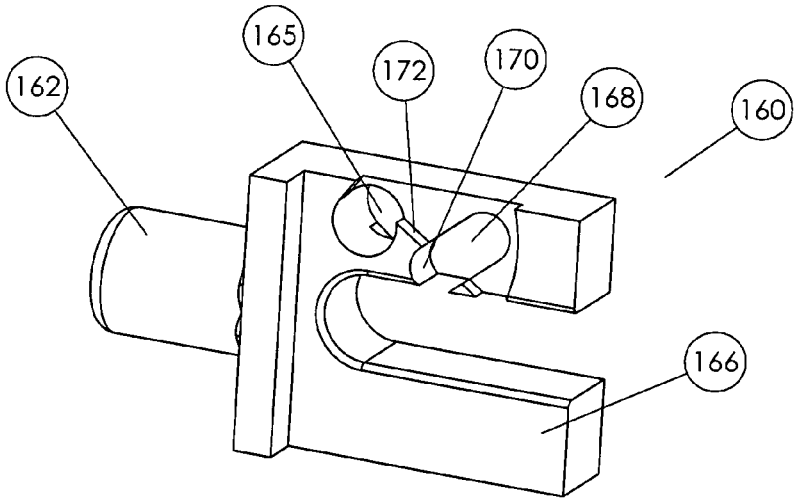
FIG. 25 is an isometric view of the opposite side of the deadbolt of FIG. 24.

The deadbolt portion of latch mechanism 50 will now be described. Referring once again to FIG. 10, two deadbolts 160 and two deadbolt cams 120 are contained between top plate 220 and stop plate 180. Shown more discretely in FIGS. 24-25, each deadbolt 161 comprises a U-shaped body portion 160 with protrusion 162 extending in the opposite direction from the leg portions of the U. First face 163 of U-shaped body 161 contains a rib 164 extending along the length of a first leg portion. This rib 164 slidably engages slot 182 in stop plate 180 (see FIG. 12) to guide the deadbolt 160 in proper orientation with respect to deadbolt relief 62 in mortise plate 60 and the mortised hole in the doorjamb or Z-bar secured to such doorjamb for receiving protrusion 162 when deadbolt 160 is in its extended (locked) position. Recessed within the first face 163 of the second leg portion of U-shaped body 161 is spring receiver hole 165 for encapsulating deadbolt spring 70.

Second face 166 on the opposite side of U-shaped body 161 contains oval-shaped cam guide 168 which is recessed into the body 161. Spring stop 172 is defined within the body between cam guide 168 and spring receiver hole 165. Spring retainer surface 174 is located adjacent to spring receiver hole 165 on first face 161. The elongated opening 176 defined between the leg portions of U-shaped body 161 accommodates key cylinder spindle 37, as described more fully below.

Figure 26:
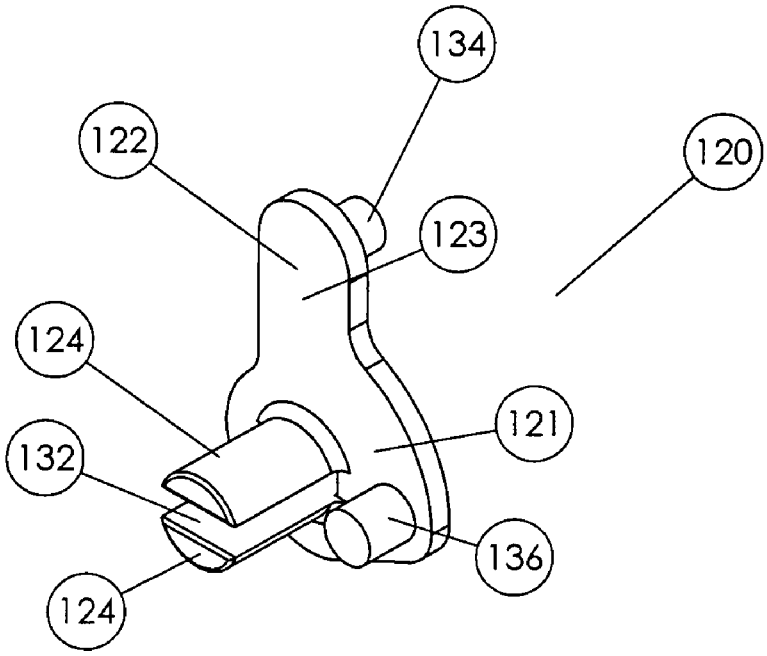
FIG. 26 is an isometric view of the deadbolt cam.
Figure 27:
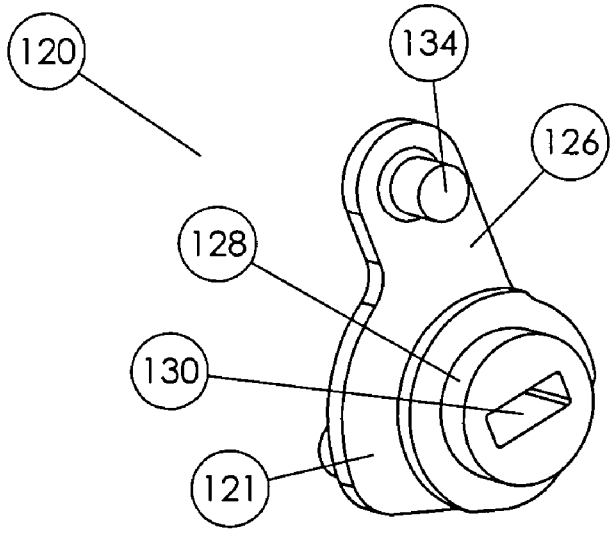
FIG. 27 is an isometric view of the opposite side of the deadbolt cam of FIG. 26.

Deadbolt cams 120 are illustrated more fully in FIGS. 26-27. Each such deadbolt cam comprises a round body portion 121 and a, finger portion 122. Extending transversely from first face 123 are two shafts 124 having a semi-circular cross section. Also extending laterally from first face 123 of body portion 121 is cam 136 which has a circular cross section.

Second face 126 on the opposite side of deadbolt cam 120 contains stem 128 extending laterally therefrom. Spindle receiver slot 130 extends through stem 128 and body portion 121. In this manner, key cylinder spindle 37 (after passing through deadbolt cam receiver holes 226 on top plate 220 and corresponding holes 184 in stop plate 180) extends through receiver slot 130 into space 132 between shafts 124 to operatively move deadbolt cam 120. Boss 134 extends from the second face 126 of finger portion 122 of deadbolt cam 120.

Figure 28:
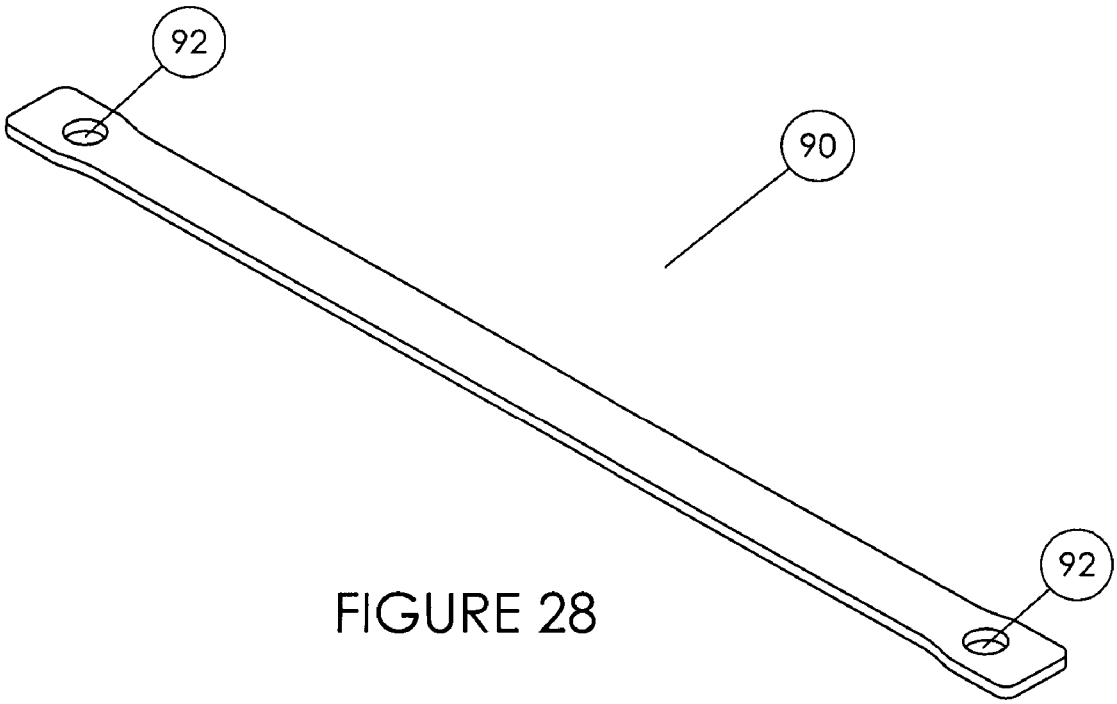
FIG. 28 is an isometric view of a link between two deadbolts.
Figure 29:
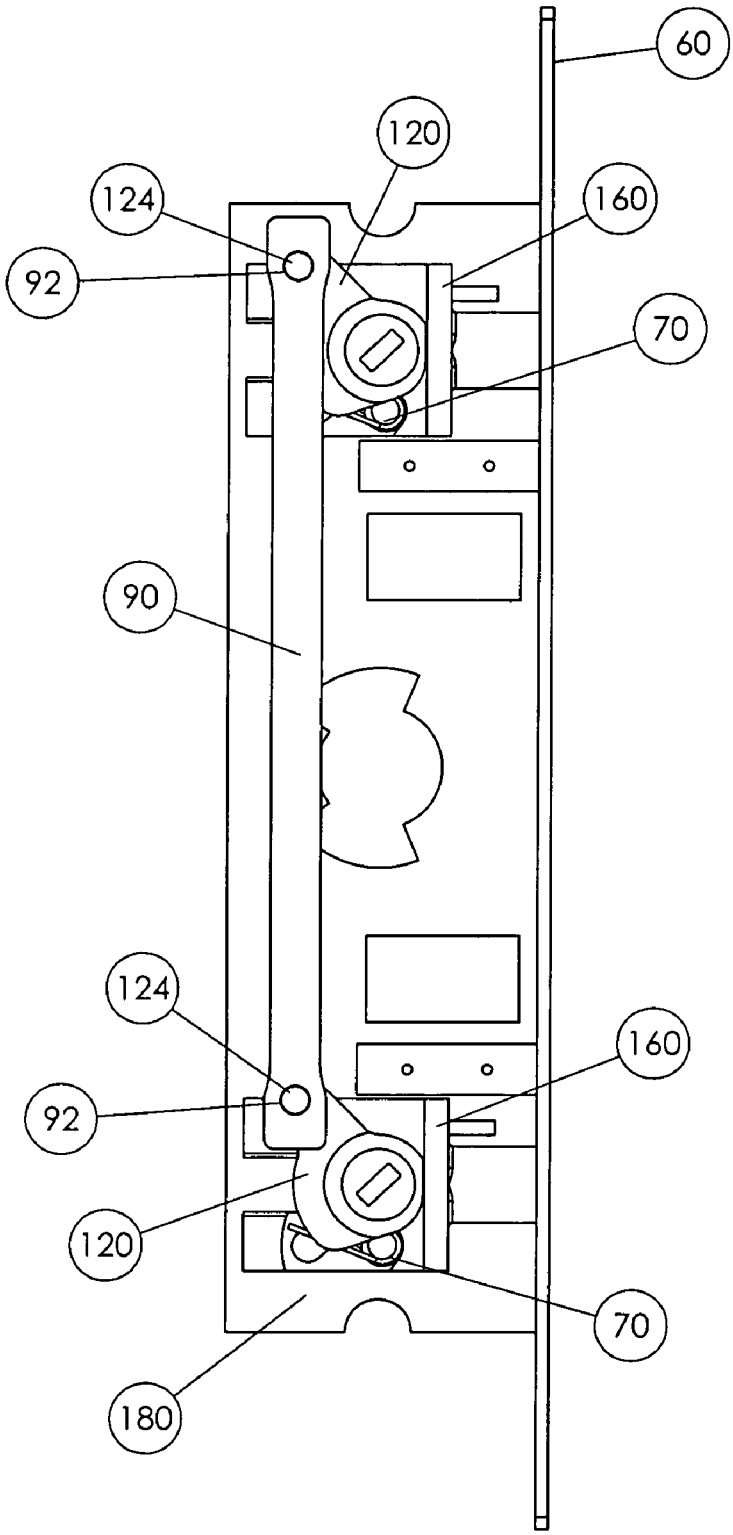
FIG. 29 is a side view of the latch bolt assembly with the deadbolts in the unlocked position and the live bolt, live bolt springs, supports, handle cam, handle springs, and caps removed.

Link 90 (FIG. 28) is an elongated strip with receiver holes 92 bored through each end. FIG. 29 shows the two deadbolts 160 and deadbolt cams connected to stop plate 180 with the deadbolts in their unlocked position. As shown, in a preferable embodiment of this invention, the two deadbolt cams 120 are connected by linkage 90 and work in unison. Receiver holes 92 in linkage 90 engage boss 134 of each deadbolt cam 120.

Figure 30:
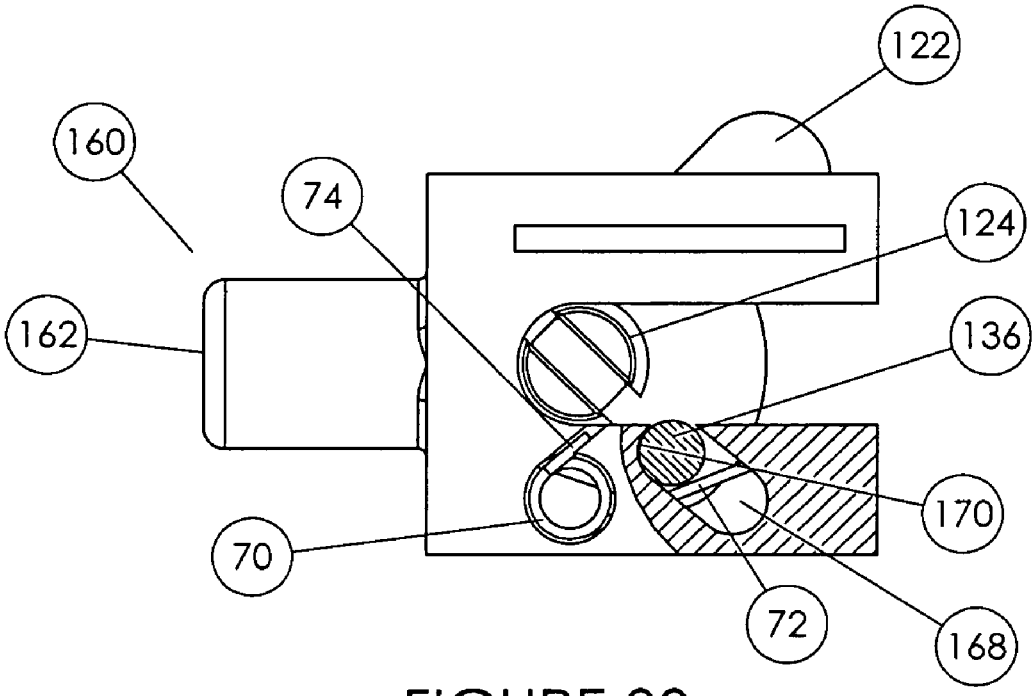
FIG. 30 is a side view of the deadbolt, deadbolt cam, and deadbolt spring as oriented with respect to each other in the unlocked position, including a broken-out view to show the interconnectivity of the cam, deadbolt spring, and bolt.
Figure 31:
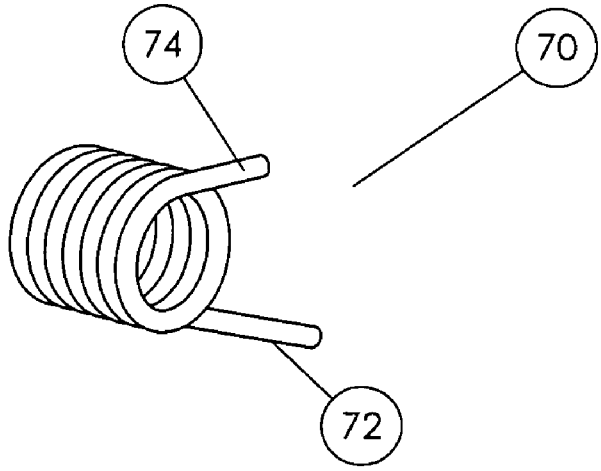
FIG. 31 is an isometric view of the deadbolt spring.

To further explain the deadbolt function, FIG. 30 shows the deadbolt and deadbolt cam relationship when in the unlocked position. Cam shaft 124 is horizontally positioned between cam 136 and protrusion 162 of deadbolt 160. Cam tab 72 of deadbolt spring 70 (See FIG. 31) applies a biasing force against cam 136 to move it towards the cam home position 170 of cam guide 168. This biases the deadbolt cam 120 to its unlocked position when cam 136 is in its home position. Meanwhile, retained tab 74 of spring 70 abuts spring stop 174 of deadbolt 160 to stabilize the spring.

Figure 32:
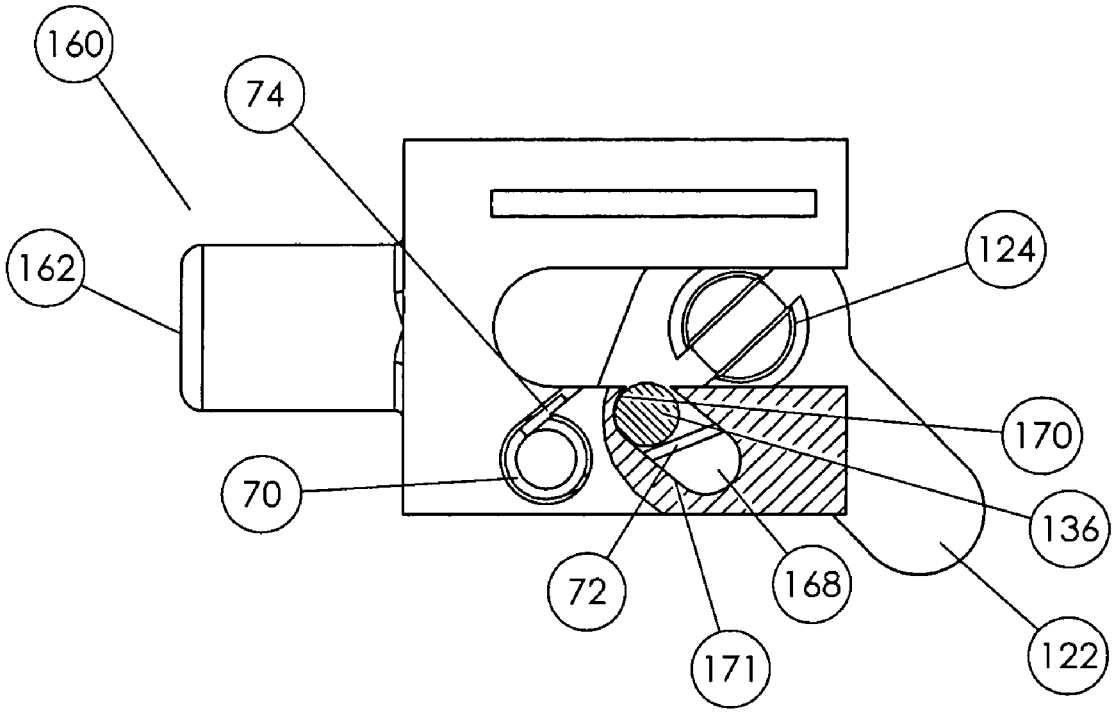
FIG. 32 is a side view of the deadbolt, deadbolt cam, and deadbolt spring as oriented with respect to each other in the locked position, including a broken-out view to show the interconnectivity of the cam, deadbolt spring, and bolt.

When a key is inserted in key cylinder 35 or thumb turn 47 is rotated to cause the finger portion 122 of deadbolt cam 120 to rotate in a clockwise direction via cam spindle 37 (see FIG. 32), cam 136 will move within cam guide 168 to the cam engaged position 171. This movement of cam 136 towards cam engaged position 171 causes deadbolt 160 to move towards the left in FIG. 32, thereby moving protrusion 162 to the extended position (locked). In this manner, deadbolt 160 will be in the locked position shown in FIG. 33. Spring tab 72 will then bias cam 136 once again to its cam home position 170 to hold the lock in this extended position until it is moved once again to the unlocked position by means of rotation of key cylinder 35 or thumb turn 47.

Figure 34:
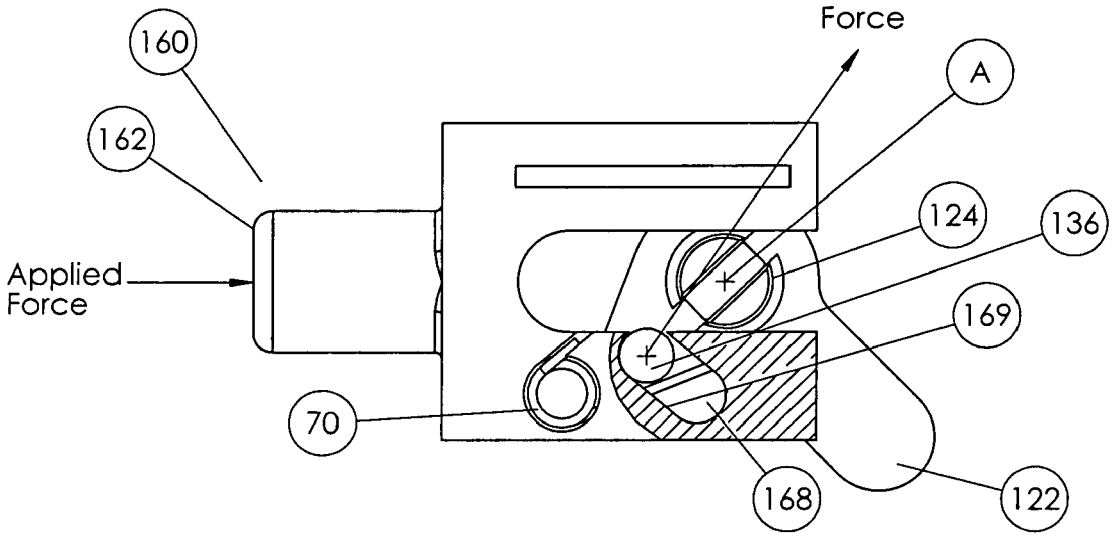
FIG. 34 is a side view of the deadbolt, deadbolt cam, and deadbolt spring of FIG. 32, showing the "true deadbolt" functionality of the deadbolt mechanism.

In an important aspect of this invention, cam guide 168 is angled with respect to protrusion 162 of deadbolt 160, so that if force were to be applied to the end of the protrusion by, e.g., an intruder trying to force the deadbolt towards a neutral or retracted position, the resulting line of force would tend to further move the deadbolt to its locked position. Referring to FIG. 34, when protrusion 162 has force applied against it as shown, bearing surface 169 of cam guide recess 168 exerts a force upon cam 136 in the direction marked "Force" in FIG. 34. This force applies a torque about point A of deadbolt cam 120 in the direction which tends to further lock the deadbolt, thereby resisting unlocking of the deadbolt. This "true deadbolt" function provides an added measure of security, as does the fact that the latch mechanism 50 contains a double deadbolt, instead of the conventional single deadbolt.

The two deadbolts 160 are preferably linked by means of linkage 90, so that actuation of one deadbolt causes simultaneous operation of both deadbolts for the sake of convenience. It is also possible for purposes of this invention, however, that deadbolts 160 will be unlinked. In this manner, for example, two different keys might be required to unlock door 12. Alternatively, only one lock may be key-actuated with the other lock remaining inoperative. In yet another embodiment, one lock could be key-actuated with the other lock only used as a "night lock" which can only be operated from the interior side of the door, and therefore not from the outside.

While this invention is illustrated with two deadbolts and associated cams, a larger number of deadbolts and cams could be easily accommodated. In order to maintain symmetry of the latch bolt assembly, an even number of deadbolts and cams should generally be employed with half of them positioned above the live bolt, and the other half positioned below the live bolt. Yet another embodiment of the present invention would be the use of a bi-directional latch mechanism, such as the one disclosed in this application, in conjunction with a only one, or an odd number, of deadbolts. While such an embodiment might not look as aesthetically pleasing because the latch and deadbolt combination lacks symmetry, a door containing such a combination could be readily flipped for both left-hand and right-hand hinged applications, since the latch mechanism would be bidirectional to allow for actuation of the door latch regardless of which end of the door is on top after installation.

The cam protrusions 162 are shown in the drawings with a circular cross section. While this shape is preferred, because it facilitates installation of the latch mechanism by permitting the installer to drill the mating mortise holes in the door jamb or Z-bar secured to such doorjamb, it should be understood that other shapes are encompassed by this invention, including squares, rectangles, hexagons, and octagons.

Figure 33:
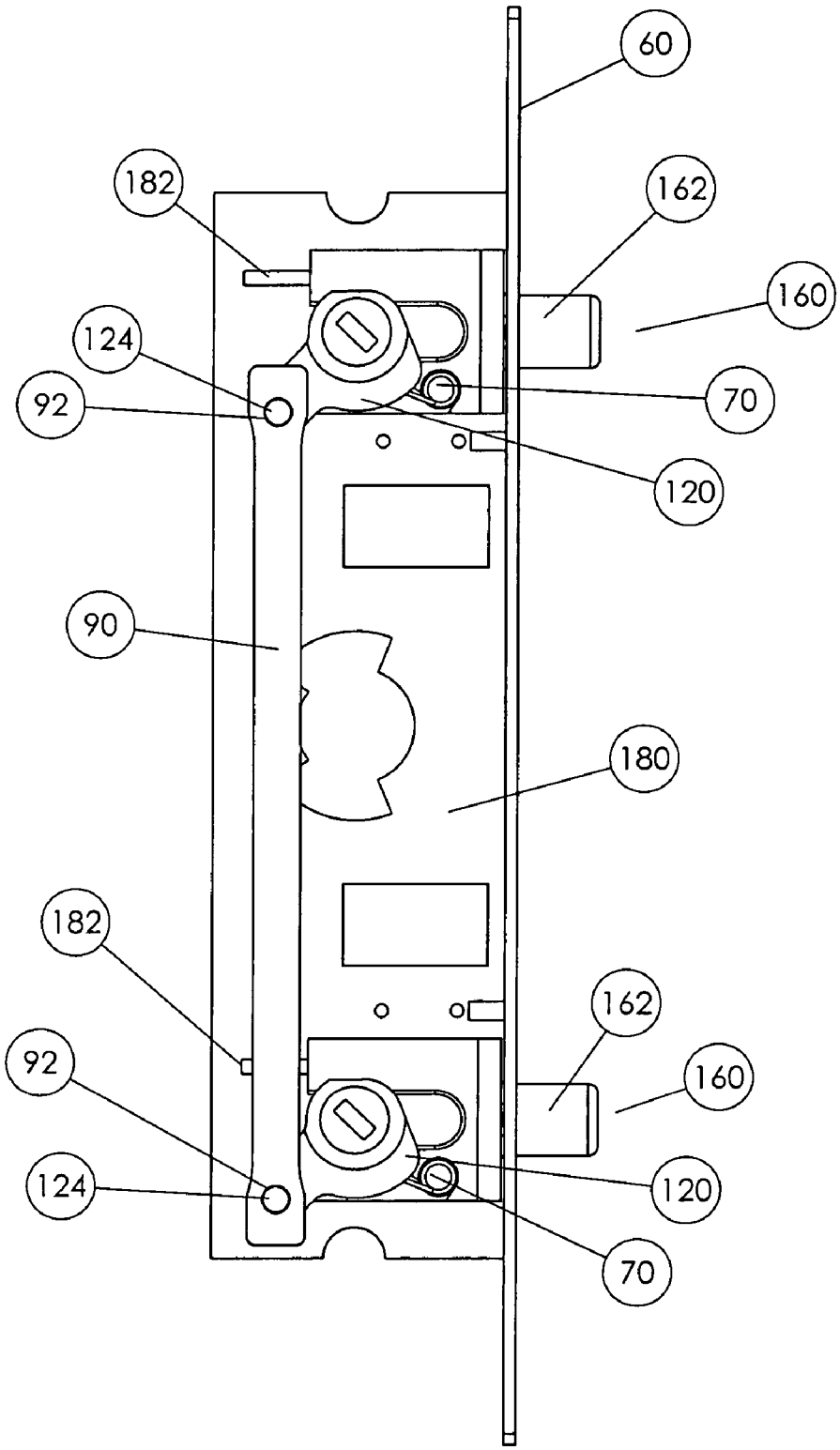
FIG. 33 is a side view of the latch bolt assembly with the deadbolts in the locked position and the live bolt, live bolt springs, supports, handle cam, handle springs, and caps removed.

It should be appreciated that exterior escutcheon plate assembly 30 and interior escutcheon plate assembly 40 look identical with the exception of key cylinder 35 and thumb turn 47. As shown in FIGS. 33-34, they could be positioned with respect to latch mechanism 50, so that a simple key cylinder spindle 37 connects key cylinder 35 and thumb turn 47 in operative engagement of the lower deadbolt cam 120. Actuation of the lower deadbolt cam 120 between the unlocked and locked position will cause a similar operation of upper deadbolt cam 120 via linkage 90. In this case, key cylinder 35 and thumb turn 47 are positioned below outside handle 32 and inside handle 42, respectively, although it should be understood that the latch bolt assembly operates similarly if the key cylinder and thumb turn were aligned and positioned above the handles.

Figure 35:
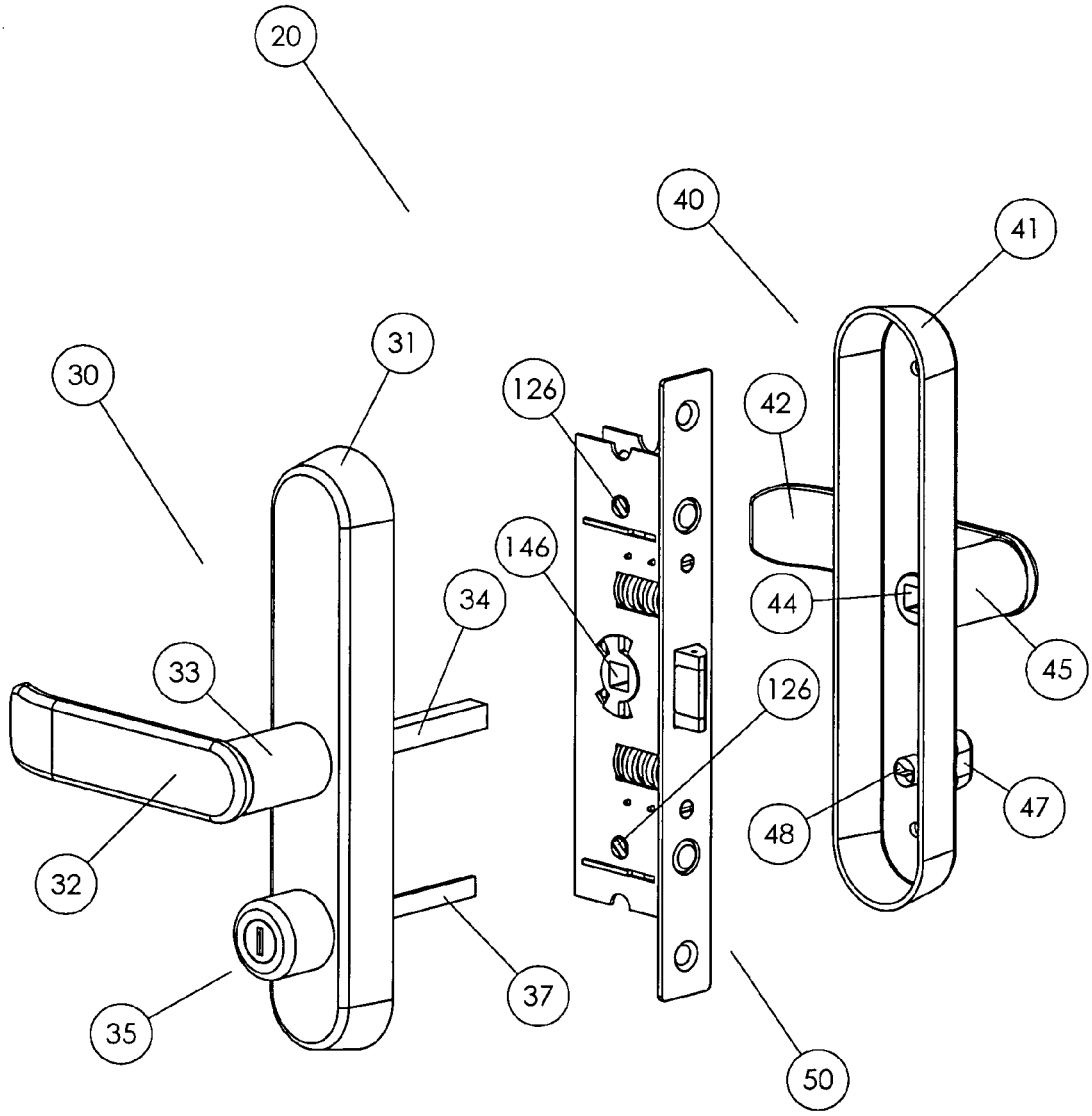
FIG. 35 is an isometric exploded view showing the latch bolt assembly, with the deadbolts in an unlocked position and the live bolt extended, and the interior and exterior escutcheon plate assemblies with the key cylinder and thumb turn in the aligned position.
Figure 36:
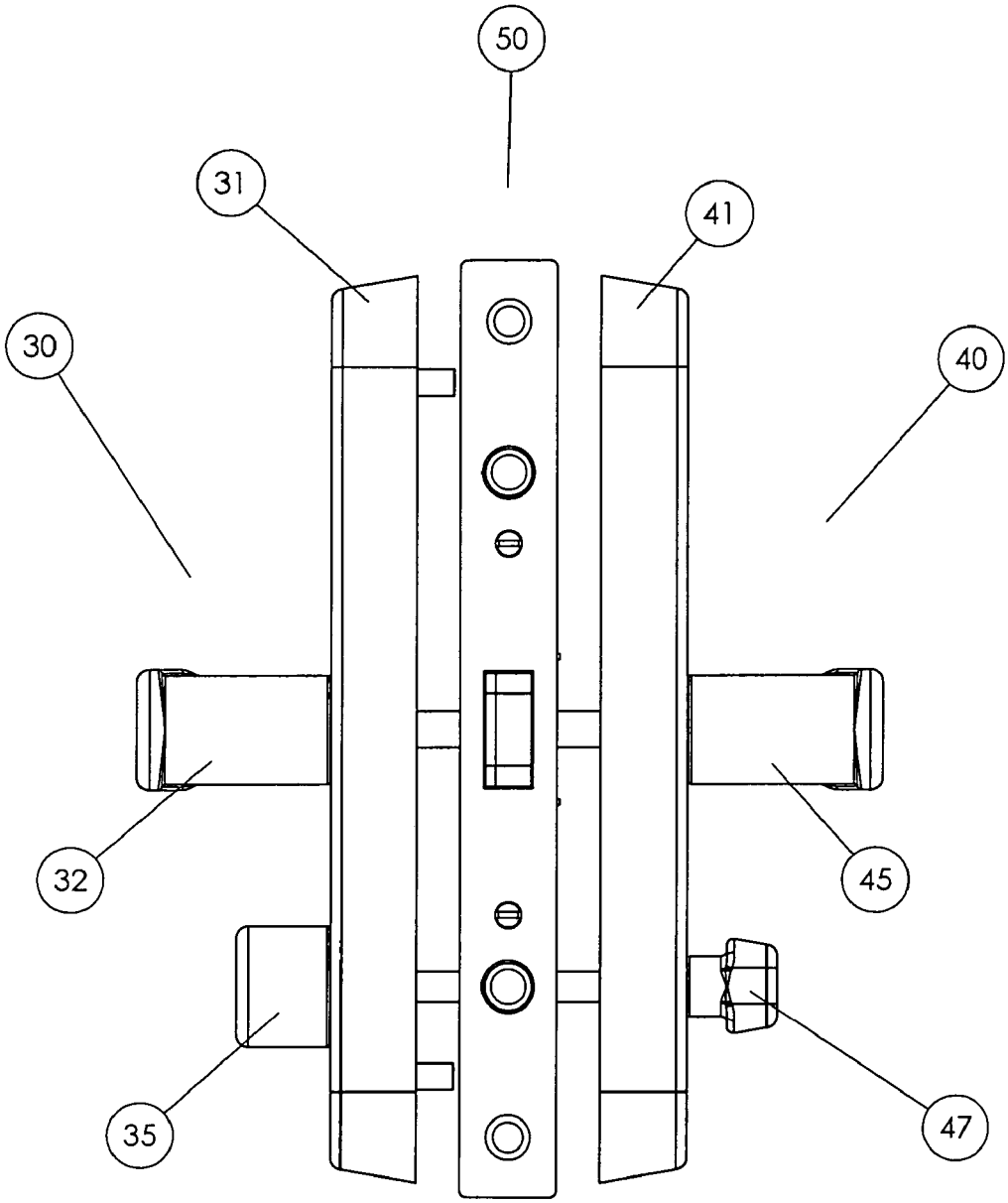
FIG. 36 is an unexploded edge view of FIG. 35.
Figure 37:
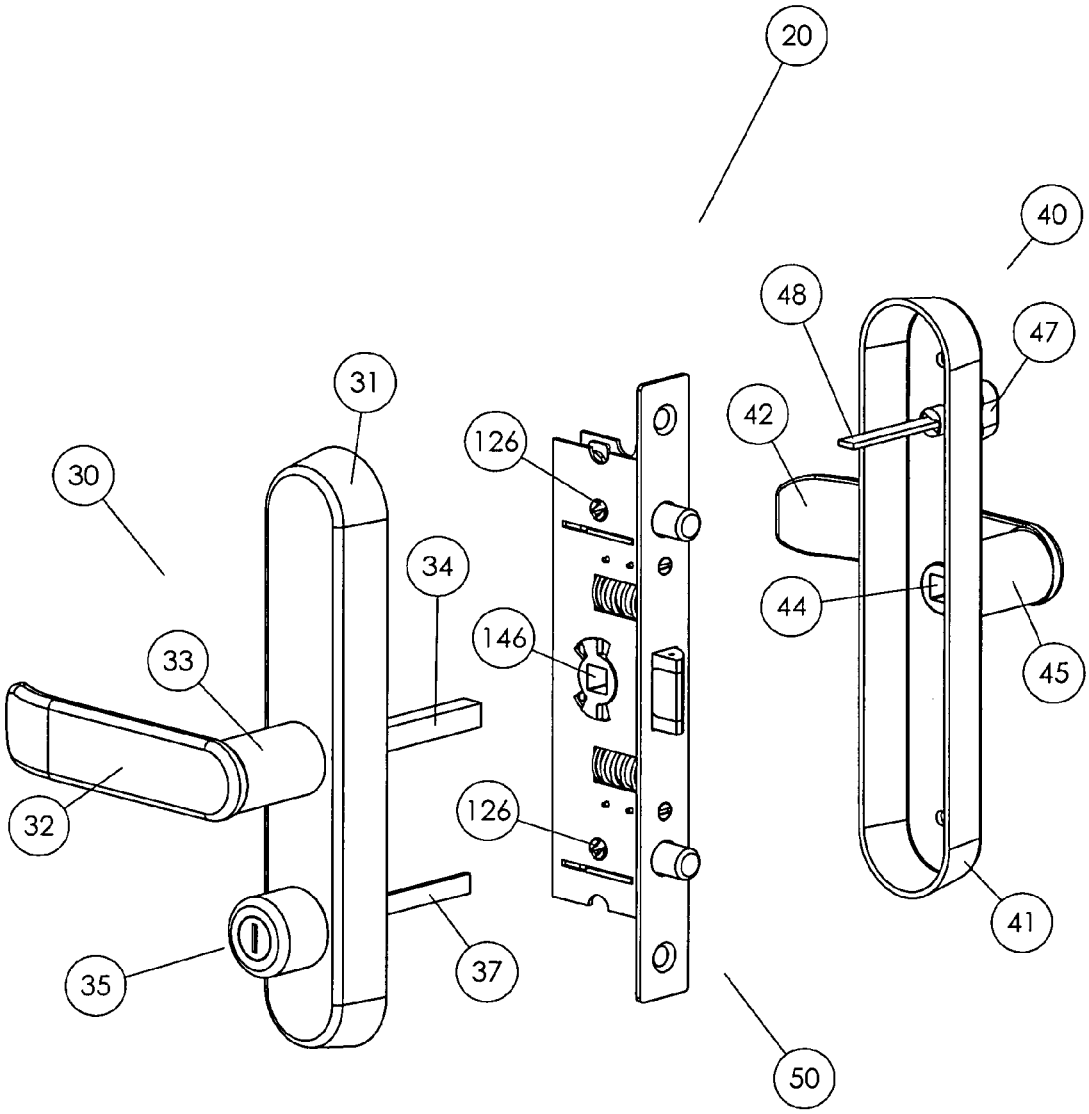
FIG. 37 is an isometric exploded view showing the latch bolt assembly with the deadbolts in a locked position, and the live bolt in an extended position, and the interior and exterior escutcheon plate assemblies with the key cylinder and thumb turn in an unaligned position.
Figure 38:
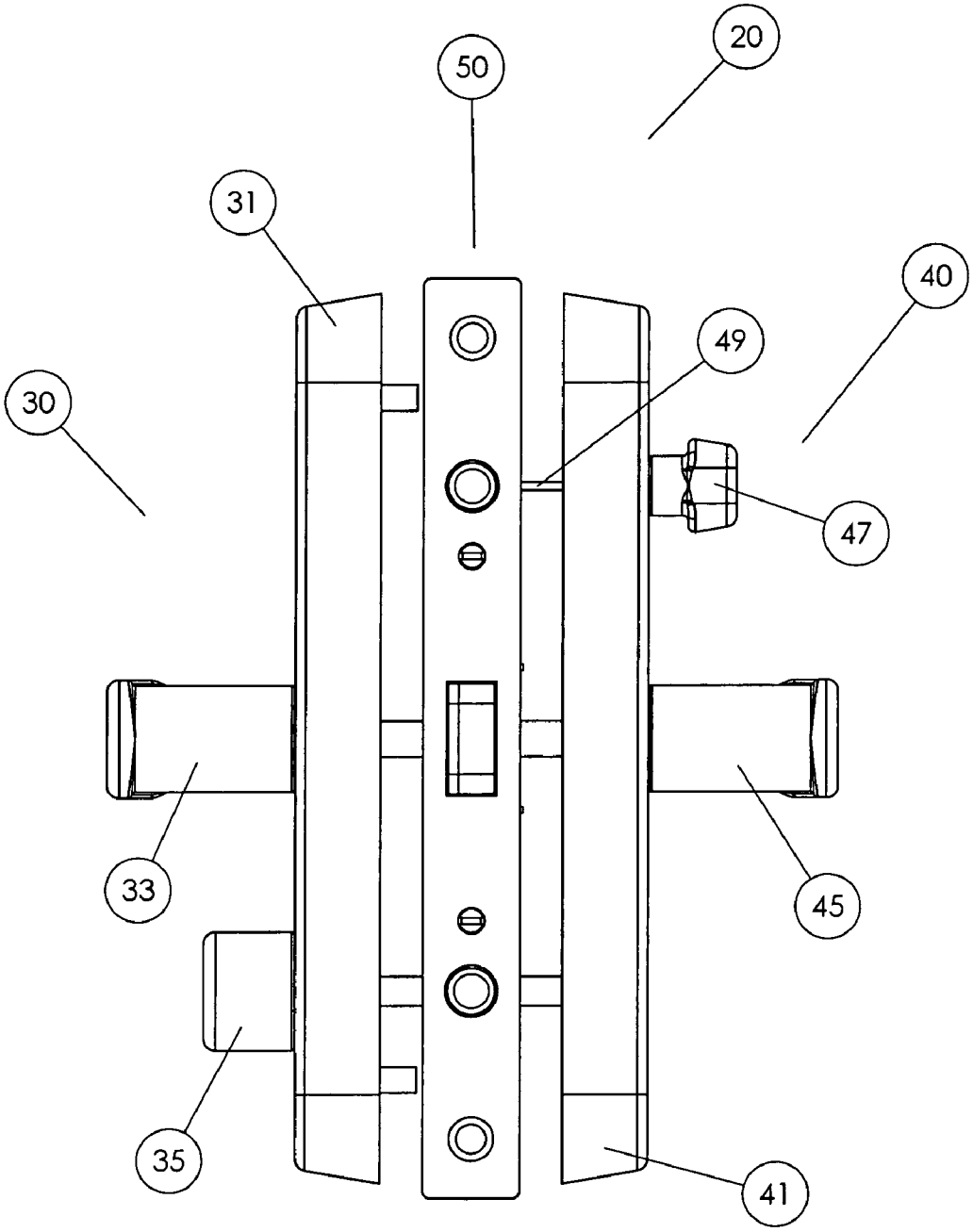
FIG. 38 is an unexploded edge view of FIG. 37.

On the other hand, interior escutcheon plate assembly 40 could be inverted, so that thumb turn 47 is positioned above interior handle 42, while key cylinder 35 remains positioned below exterior handle 32 (see FIGS. 35-36). In this case, first cylinder shaft 37 would extend from key cylinder 35 to operatively engage lower deadbolt cam 120, while a separate turn spindle 49 would extend from thumb turn 47 to operatively engage upper deadbolt cam 120. Actuation of either deadbolt cam 120 would cause simultaneous operation of the other deadbolt cam 120 via linkage 90, as described above. It should be appreciated that they key cylinder may be positioned above the handle with the thumb turn positioned below the handle, if so desired. This ability to invert exterior escutcheon plate assembly 30 and interior escutcheon plate assembly 40 with respect to each other allows enhanced aesthetic flexibility in the installation of the latch mechanism of the present invention.

Figure 39:
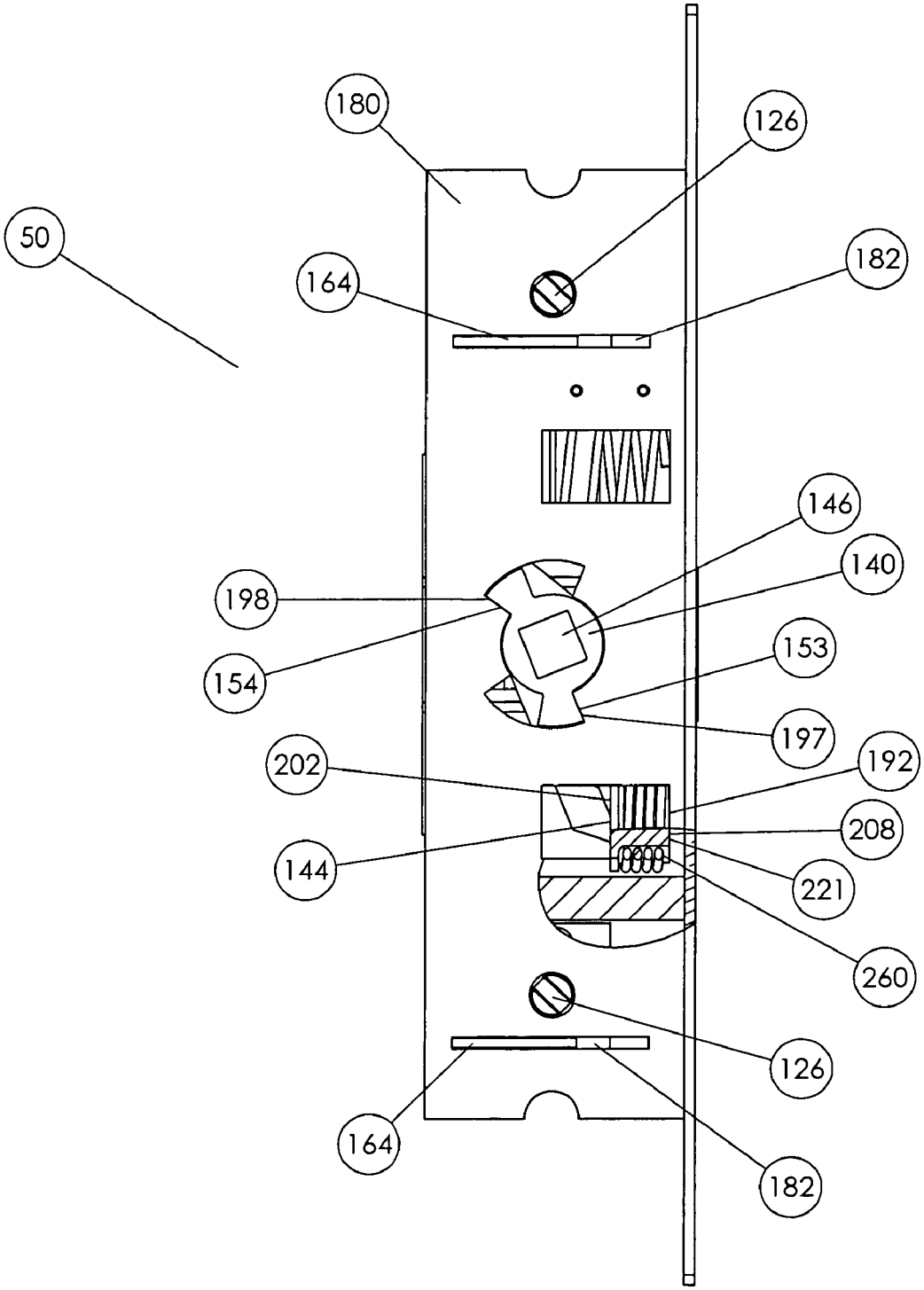
FIG. 39 is a side view of the latch mechanism with the handle cam rotated, including a broken-out view to show the cap contact at full rotation.

Referring to FIG. 39, the latch mechanism is show in the "rotated" position. Rotation occurs by a torque being applied from a handle to the handle spindle receiver 146, whereupon the abutting surface 144 then applies a force to the top 202 of cap 200, further compressing handle spring 260. The relationship of deadbolt slot 182 and guide rib 164 is also illustrated. Also shown are the catastrophic load stops for handle cam 140. As shown in FIG. 39, handle cam 140 abuts stop plate 180 at two locations. Forward stop B 198 abuts first stop B 155, while simultaneously rear stop B 197 abuts second stop B 156. In addition, handle spring end 208 abuts handle spring stops 192 and 221, providing further distribution of the potentially catastrophic torque load. This reduces the stress loading effect on the handle cam 140, which provides a substantial safety improvement. FIG. 39 also depicts the abutment of the cap to the handle spring stops 192 and 221 in the broken-out sectional view.

The above specification and drawings provide a complete description of the structure and operation of the latch bolt assembly of the invention and the installation of a door containing such latch bolt assembly. However, the invention is capable of use in various other combinations, modifications, embodiments, and environments without departing from the spirit and scope of the invention. For example, instead of a rotary handle-operated live bolt, a push-pull latch could be employed to actuate the live bolt. Co-pending application U.S. Ser. No. 10/352,323 filed on Jan. 29, 2003 and Ser. No. 11/043,212 filed on Jan. 26, 2005 by the inventor or the present application discusses in greater detail the structure and operation of such a push-pull latch, and its specification is hereby incorporated by reference into the present application. Likewise, a surface-mounted latch could be used instead of a reciprocating live bolt mortised into the door. An example of such a surface-mounted latch is a push-button latch traditionally used on storm doors, including but not limited to the device disclosed in U.S. Pat. No. 4,864,835 issued to Wartian. Yet another alternative embodiment would be the use of a shaft integrally connected to the door handle, thumb turn, or key cylinder, instead of a separate spindle. Therefore, the invention resides in the claims hereinafter appended. Moreover, the embodiments described in this application are further intended to explain best modes known for practicing the invention and to enable others skilled in the art to utilize the invention in such, or other, embodiments, and with various modifications required by the particular applications and uses of the invention. Therefore, this description is not intended to limit the invention to the particular form disclosed herein.

What is claimed is:

1. A compact reversible latch bolt assembly for use with right and left hand doors, mountable within a bore defined along an edge of a door, comprising:

(a) a lock body including a pair of spaced side plates;

(b) a live bolt having a door jamb plate engagement surface, the live bolt being mounted between the side plates with the door jamb plate engagement surface always facing a first side of the lock body for movement between an extended position with the door jamb plate engagement surface extending from the lock body and a retracted position with the live bolt fully retracted into the lock body;

(c) a first actuation means mounted between the side plates in operative engagement with the live bolt for movement of the live bolt between the extended position and retracted position;

(d) two deadbolts mounted between the side plates adjacent to but on opposite sides of and equidistant from the live bolt for linear movement between a locked position, with a first end of at least one deadbolt extending from the lock body to engage a door jamb, and an unlocked position, with both deadbolts fully retracted within the lock body to permit the door to be opened;

(e) first and second deadbolt cams, each cam being rotatably mounted within the lock body in direct engagement with a corresponding deadbolt to move the corresponding deadbolt between the locked position and the unlocked position;

(f) a second actuation means in operative engagement with at least one of the deadbolt cams for rotating at least one cam to actuate movement of the corresponding deadbolt between its locked and unlocked position;

wherein the latch assembly can be selectively mounted within the door bore with the live bolt door jamb plate engagement surface facing a desired side of the door to accommodate a left hand or right hand door; and (g) a cam linkage mounted within the lock body, said cam linkage having a first end pivotally secured to the first cam and having a second end pivotally secured to the second cam, so that upon actuation of one of the cams, the other cam will be simultaneously actuated.

2. The reversible latch bolt assembly of claim 1, wherein the first actuation means is rotatably mounted to the lock body in operative engagement with the live bolt for movement of the live bolt between the extended position and the retracted position.

3. The reversible latch bolt assembly of claim 1, wherein the first actuation means comprises a push-pull actuator in operative engagement with the live bolt.

4. The reversible latch bolt assembly of claim 1 further comprising at least one bias means mounted to the latch and at least one of the side plates or a door for biasing the latch into the extended position.

5. The reversible latch bolt assembly of claim 4, wherein the bias means comprises a compression spring.

6. The latch bolt assembly of claim 1, wherein the first actuation means comprises a handle cam rotatably mounted between the side plates in operative engagement with the live bolt for linear movement of the live bolt between its extended position and its retracted position in response to rotation of the cam.

7. The reversible latch bolt assembly of claim 6, wherein the handle cam is operatively connected to an external actuator for applying a rotational force to the cam.

8. The reversible latch bolt assembly of claim 7, wherein the external actuator comprises a door lever.

9. The reversible latch bolt assembly of claim 7, wherein the external actuator comprises a door knob.

10. The reversible latch bolt assembly of claim 6 further comprising bias means mounted to the handle cam for biasing the cam in a neutral position with the live bolt in its extended position.

11. The reversible latch bolt assembly of claim 10, wherein the actuator bias means comprises a compression spring positioned between one end of the cam and the lock body.

12. The reversible latch bolt assembly of claim 1, wherein the live bolt includes a strike plate and the first actuation means includes a rotatably mounted handle cam with opposed, radially extending followers that operatively engage the strike plate upon rotation of the handle cam to draw the bolt into its retracted position.

13. The reversible latch bolt assembly of claim 1 wherein:

(a) the first actuation means for the live bolt comprises a handle cam rotatably mounted between the side plates in operative engagement with the live bolt for linear movement of the live bolt between its extended position and its retracted position in response to rotation of the handle cam;

(b) a boss extending laterally from the handle cam along the axis of rotation of the handle cam; and (c) a channel defined in the lock body for mating engagement with the boss;

whereby the engagement of the cam boss and channel limits the rotational travel of the handle cam within the lock body.

14. The reversible latch bolt assembly of claim 1 wherein:

(a) each deadbolt includes at least one flange extending laterally from at least one side of the deadbolt;

(b) at least one side plate includes a guide track for slidably receiving the deadbolt flange to linearly guide the deadbolt between its retracted and extended positions.

15. The reversible latch bolt assembly of claim 1 further comprising:

(a) at least one flange extending laterally from at least one side of the live bolt;

(b) at least one live bolt guide track defined in at least one side plate for receiving the live bolt flange to linearly guide the live bolt between the retracted and extended positions.

16. The reversible latch bolt assembly of claim 1, further comprising:

(a) a boss protruding from one face of each deadbolt cam;

(b) an elongated guide slot formed within each deadbolt for mating engagement with the boss on the deadbolt cam;

whereby rotation of a deadbolt cam causes the boss to engage a corresponding deadbolt as the boss is guided through the slot to move the deadbolt between its locked and unlocked positions.

17. The reversible latch bolt assembly of claim 16, wherein the elongated guide slot in each deadbolt is angled with respect to the longitudinal axis of travel of the deadbolt to define a bearing surface.

18. The reversible latch bolt assembly of claim 1, wherein such latch bolt assembly has been preassembled into a door by a manufacturer or retailer of the door.

* * * * *